US005861218A

United States Patent [19]

Sakurai et al.

[11] Patent Number: 5,861,218

[45] Date of Patent: Jan. 19, 1999

[54] ZINCIFEROUS PLATED STEEL SHEET AND METHOD FOR MANUFACTURING SAME

[75] Inventors: Michitaka Sakurai; Akira Hiraya; Junichi Inagaki; Takayuki Urakawa; Satoshi Hashimoto; Toru Imokawa; Masaaki Yamashita, all of Fukuyama; Toyofumi Watanabe, Yokohama, all of Japan

[73] Assignee: NKK Cororation, Tokyo, Japan

[21] Appl. No.: 557,083

[22] PCT Filed: Sep. 26, 1995

[86] PCT No.: PCT/JP95/01947

§ 371 Date: Dec. 5, 1995

§ 102(e) Date: Dec. 5, 1995

[87] PCT Pub. No.: WO96/10103

PCT Pub. Date: Apr. 4, 1996

[30] Foreign Application Priority Data

| | | | |
|---|---|---|---|
| Jul. 31, 1995 | [JP] | Japan | 7-214018 |
| Aug. 1, 1995 | [JP] | Japan | 7-216589 |
| Sep. 27, 1997 | [JP] | Japan | 6-257499 |

[51] Int. Cl.[6] ..... B32B 15/18; C25D 3/56; C23C 28/00

[52] U.S. Cl. ..... 428/639; 428/658; 428/659; 428/935; 428/936; 205/255; 427/438

[58] Field of Search ..... 428/659, 939, 428/935, 936, 680, 658, 686, 632, 639, 633; 205/184, 177, 255, 217; 148/537; 427/438

[56] References Cited

U.S. PATENT DOCUMENTS

| | | | |
|---|---|---|---|
| 4,578,122 | 3/1986 | Crotty | 148/6.2 |
| 4,663,245 | 5/1987 | Yoshida et al. | 428/659 |
| 4,670,354 | 6/1987 | Polard et al. | 428/659 |
| 4,835,066 | 5/1989 | Taisuke et al. | 428/659 |
| 4,853,295 | 8/1989 | Shindo et al. | 428/659 |
| 5,409,553 | 4/1995 | Sagiyama et al. | 148/516 |
| 5,447,802 | 9/1995 | Tobiyama et al. | 428/659 |

FOREIGN PATENT DOCUMENTS

| | | | |
|---|---|---|---|
| 0 034 040 | 8/1981 | European Pat. Off. . | |
| 0 235 297 | 9/1987 | European Pat. Off. . | |
| 53-60332 | 5/1978 | Japan . | |
| 58-67885 | 4/1983 | Japan . | |
| 60-63394 | 4/1985 | Japan . | |
| 62-267497 | 11/1987 | Japan . | |
| 63-243282 | 10/1988 | Japan | 428/659 |
| 1-119651 | 5/1989 | Japan . | |
| 1-119652 | 5/1989 | Japan . | |
| 2-190483 | 7/1990 | Japan . | |
| 3-17282 | 1/1991 | Japan . | |
| 3-191093 | 8/1991 | Japan . | |
| 4-41683 | 2/1992 | Japan . | |
| 4-48082 | 2/1992 | Japan . | |
| 4-88196 | 3/1992 | Japan . | |
| 4-50387 | 8/1992 | Japan . | |
| 6-101065 | 4/1994 | Japan . | |
| 2 097 024 | 10/1982 | United Kingdom . | |
| 2161499 | 1/1986 | United Kingdom | 428/659 |
| WO 91/11542 | 8/1991 | WIPO . | |

OTHER PUBLICATIONS

Abstract of JP 52 152 834, "Treating galvanised steel plate before painting –with aq. acid soln. containing e.g. iron chloride, cobalt chloride or nickel chloride to give good adhesion and corrosion resistance", *Derwent Publications Ltd.*, London, 1977, no month.

*Primary Examiner*—John J. Zimmerman
*Attorney, Agent, or Firm*—Frishauf, Holtz, Goodman, Langer & Chick, P.C.

[57] ABSTRACT

A zinciferous plated steel sheet which comprises a steel sheet, at least one zinciferous plating layer formed on at least one surface of the steel sheet, and an Fe—Ni—O film as an uppermost layer formed on the zinciferous plating layer. The total quantity of metallic elements in the Fe—Ni—O film is within a range of from 10 to 1,500 mg/m$^2$, and the oxygen content in the Fe—Ni—O film is within a range of from 0.5 to under 30 wt. %. The ratio of the iron content (g/l) relative to the total quantity of the iron content (g/l) and the nickel content (g/l) in the Fe—Ni—O film is preferably within a range of from over 0 to under 1.0.

16 Claims, 5 Drawing Sheets

ZINCIFEROUS PLATED STEEL SHEET AND METHOD FOR MANUFACTURING SAME

This application is an application filed under 35 U.S.C. 371 from PCT/JP95/01947 Sep. 26, 1995.

FIELD OF THE INVENTION

The present invention relates to a zinciferous plated steel sheet, and more particularly, to a zinciferous plated steel sheet which is excellent in press-formability, and furthermore, is excellent in at least one of spot-weldability, adhesiveness and chemical treatability, depending upon the use, and a method for manufacturing same.

BACKGROUND OF THE INVENTION

Because of the various excellent advantages, zinciferous plated steel sheets are widely applied as various rust-preventive steel sheets. In order to use these zinciferous plated steel sheets as rust-preventive steel sheets for automobile, it is important for these steel sheets to be excellent in press-formability, spot-weldability, adhesiveness and chemical treatability as properties required in the manufacturing step of automobile bodies, in addition to corrosion resistance and painting adaptability.

The zinciferous plated steel sheet is however defective in that it is low in press-formability in general as compared with a cold-rolled steel sheet. This is attributable to a large sliding resistance between the zinciferous plated steel sheet and a die of a press as compared with sliding resistance between the cold-rolled steel sheet and a die of a press. More specifically, since the zinciferous plated steel sheet has a large sliding resistance, it becomes difficult for the zinciferous plated steel sheet to flow into the die of the press at a portion where sliding resistance between a bead of the die of the press and the zinciferous plated steel sheet is very large, and fracture tends to easily occur in the zinciferous plated steel sheet.

A method which comprises applying a high-viscosity lubricant oil onto the surface of a zinciferous plated steel sheet is commonly used as a method for improving press-formability of the zinciferous plated steel sheet. This method has however drawbacks in that the high-viscosity of the lubricant oil causes a defective degreasing, which results in a painting defect in the painting step, and lack of the lubricant oil during the press-forming causes unstable press-formability. There is therefore a strong demand for improvement of press-formability of the zinciferous plated steel sheet.

During the spot-welding of the zinciferous plated steel sheet, on the other hand, a copper electrode reacts with molten zinc, and this tends to form a brittle alloy phase. A problem in the zinciferous plated steel sheet is therefore that wear of the copper electrode is serious, leading to a short service life thereof, and as a result, the zinciferous plated steel sheet is poorer in continuous spot-weldability than the cold-rolled steel sheet.

In the manufacturing step of an automobile body, furthermore, various adhesive agents are used for the purposes of rust prevention and inhibition of vibration of the automobile body. Recently, however, adhesiveness of the zinciferous plated steel sheet has been found to be lower than that of the cold-rolled steel sheet.

As a method for solving the above-mentioned problems, Japanese Patent Provisional Publication No. 53-60,332 published on May 30, 1978 and Japanese Patent Provisional Publication No. 2-190,483 published on Jul. 26, 1990 disclose a technology for improving weldability or workability of a zinciferous plated steel sheet, which comprises subjecting the zinciferous plated steel sheet to an electrolytic treatment, a dipping treatment, an application/oxidation treatment or a heating treatment, thereby forming an oxide film mainly comprising zinc oxide (ZnO) on the surface of the zinciferous plated steel sheet (hereinafter referred to as the "prior art 1").

Japanese Patent Provisional Publication No. 4-88,196 published on Mar. 23, 1992 discloses a technology for improving press-formability and chemical treatability of a zinciferous plated steel sheet, which comprises dipping the zinciferous plated steel sheet in an aqueous solution containing sodium phosphate in an amount within a range of from 5 to 60 g/l and having a pH value within a range of from 2 to 6, or spraying said aqueous solution onto the surface of the zinciferous plated steel sheet, or subjecting the zinciferous plated steel sheet to an electrolytic treatment in said aqueous solution, thereby forming an oxide film mainly comprising phosphorus oxide on the surface of the zinciferous plated steel sheet (hereinafter referred to as the "prior art 2").

Japanese Patent Provisional Publication No. 3-191,093 published on Aug. 21, 1991 discloses a technology for improving press-formability and chemical treatability of a zinciferous plated steel sheet, which comprises subjecting the zinciferous plated steel sheet to an electrolytic treatment, a dipping treatment, an application treatment, an application/oxidation treatment or a heating treatment, thereby forming a nickel oxide film on the surface of the zinciferous plated steel sheet (hereinafter referred to as the "prior art 3").

Japanese Patent Provisional Publication No. 5-867,885 published on Apr. 22, 1983 discloses a technology for improving corrosion resistance of a zinciferous plated steel sheet, which comprises subjecting the zinciferous plated steel sheet, for example, to an electroplating treatment or a chemical plating treatment, thereby forming a metallic film of nickel and/or iron on the surface of the zinciferous plated steel sheet (hereinafter referred to as the "prior art 4").

Japanese Patent Provisional Publication No. 3-17,282 published on Jan. 25, 1991 discloses a method for causing the substitution/precipitation of at least one metal selected from the group consisting of iron, nickel and cobalt on the surface of a zinciferous plated steel sheet (hereinafter referred to as the "prior art 5").

Japanese Patent Provisional Publication No. 6-063,394 published on Apr. 11, 1985 discloses a method for applying an aqueous solution containing ingredients of an inert film on the surface of a zinciferous plated steel sheet (hereinafter referred to as the "prior art 6").

The above-mentioned prior arts 1 to 6 have however the following problems:

(1) In the prior art 1, since an oxide film mainly comprising zinc oxide (ZnO) is formed on the surface of the zinciferous plating layer by any of the various treatments as described above, ordinary weldability, i.e., joinability between welded sheets, and workability except for press-formability of the zinciferous plated steel sheet, are improved, whereas the reducing effect of sliding resistance between the die of the press and the zinciferous plated steel sheet is slight. It is therefore difficult to improve press-formability of the zinciferous plated steel sheet, and the existence of an oxide film mainly comprising zinc oxide on the surface of the zinciferous plating layer, causes degradation of adhesiveness of the zinciferous plated steel sheet.

(2) In the prior art 2, an oxide film mainly comprising phosphorus oxide is formed on the surface of the zinciferous plating layer. Therefore, while press-formability and chemical treatability of the zinciferous plated steel sheet are improved, spot-weldability and adhesiveness thereof are degraded.

(3) In the prior art 3, a film of a single phase of nickel oxide is formed on the surface of the zinciferous plating layer. While, therefore, press-formability of the zinciferous plated steel sheet is improved, adhesiveness thereof is degraded.

(4) In the prior art 4, a metallic film of nickel or the like is formed on the surface of the zinciferous plating layer. This improves corrosion resistance of the zinciferous plated steel sheet. However, because of the strong metal properties of the film described above, there is unavailable a sufficient improving effect of press-formability and spot-weldability of the zinciferous plated steel sheet. In addition, the prior art 4 poses another problem in that a low wettability of the metal to an adhesive agent makes it difficult to obtain a sufficient adhesiveness of the zinciferous plated steel sheet.

(5) In the prior art 5, a metallic film substitution-precipitated on the surface of the zinciferous plated steel sheet has only a low wettability to an adhesive agent, thus making it difficult to obtain a sufficient adhesiveness of the zinciferous plated steel sheet. Because of the strong metal properties of the film described above, there is available only a slight improving effect of press-formability and spot-weldability of the zinciferous plated steel sheet. The aqueous solution for forming the metallic film has a low pH value and a low efficiency of substitution/precipitation. A sufficient quantity of deposited metal cannot therefore be ensured. In order to ensure a sufficient quantity of deposited metal, therefore, it is necessary to increase a temperature of the aqueous solution, resulting in such problems as an increased manufacturing cost including an increased consumption of energy and an installation of heating facilities of the aqueous solution.

(6) In the prior art 6, an inert film is formed on the surface of the zinciferous plated steel sheet. Chemical treatability and adhesiveness of the zinciferous plated steel sheet are degraded as a result.

An object of the present invention is therefore to solve the above-mentioned problems involved in the prior arts 1 to 6, and to provide a zinciferous plated steel sheet, particularly a zinciferous plated steel sheet which is excellent in press-formability, and furthermore, is excellent in at least one of spot-weldability, adhesiveness and chemical treatability, depending upon the use.

Another object of the present invention is to solve the above-mentioned problems involved in the prior arts 1, 3, 5 and 6, and to provide a method for manufacturing a zinciferous plated steel sheet, particularly a zinciferous plated steel sheet which is excellent in press-formability, and furthermore, is excellent in at least one of spot-weldability, adhesiveness and chemical treatability, depending upon the use.

DISCLOSURE OF THE INVENTION

In the present invention, the term "Fe—Ni—O film" means a composite film which comprises at least two metals of iron and nickel, and oxides thereof.

In accordance with one of the features of the present invention, there is provided a zinciferous plated steel sheet, which comprises:

a steel sheet, at least one zinciferous plating layer formed on at least one surface of said steel sheet, and an Fe—Ni—O film as an uppermost layer formed on said at least one zinciferous plating layer;

a total quantity of metallic elements contained in said Fe—Ni—O film being within a range of from 10 to 1,500 mg/M$^2$; and an oxygen content in said Fe—Ni—O film being within a range of from 0.5 to under 30 wt. % (hereinafter referred to as the "zinciferous plated steel sheet No.1 of the present invention").

In the zinciferous plated steel sheet No. 1 of the present invention, spot-weldability and/or adhesiveness thereof can be improved by limiting a ratio of an iron content (wt. %) relative to a total quantity of the iron content (wt. %) and a nickel content (wt. %) in said Fe—Ni—O film within a range of from over 0 to under 1.0.

In accordance with one of the features of the present invention, there is provided a zinciferous plated steel sheet, which comprises, in addition to the features of the zinciferous plated steel sheet No. 1 of the present invention:

the ratio of the iron content (wt. %) relative to the total quantity of the iron content (wt. %) and the nickel content (wt. %) in said Fe—Ni—O film being within a range of from over 0 to 0.9 (hereinafter referred to as the "zinciferous plated steel sheet No. 2 of the present invention").

In accordance with one of the features of the present invention, there is provided a zinciferous plated steel sheet, which comprises, in addition to the features of the zinciferous plated steel sheet No. 1 of the present invention:

the ratio of the iron content (wt. %) relative to the total quantity of the iron content (wt. %) and the nickel content (wt. %) in said Fe—Ni—O film being within a range of from 0.05 to under 1.0

(hereinafter referred to as the "zinciferous plated steel sheet No. 3 of the present invention").

In accordance with one of the features of the present invention, there is provided a zinciferous plated steel sheet, which comprises, in addition to the features of the zinciferous plated steel sheet No. 1 of the present invention:

the ratio of the iron content (wt. %) relative to the total quantity of the iron content (wt. %) and the nickel content (wt. %) in said Fe—Ni—O film being within a range of from 0.05 to 0.9, and the oxygen content in said Fe—Ni—O film being within a range of from 0.5 to 10 wt. %

(hereinafter referred to as the "zinciferous plated steel sheet No. 4 of the present invention").

In accordance with one of the features of the present invention, there is provided a zinciferous plated steel sheet, which comprises, in addition to the features of the zinciferous plated steel sheet No. 4 of the present invention:

the total quantity of said metallic elements contained in said Fe—Ni—O film being within a range of from 10 to 1,200 mg/m$^2$, and the ratio of the iron content (wt. %) relative to the total quantity of the iron content (wt. %) and the nickel content (wt. %) in said Fe—Ni—O film being within a range of from 0.1 to 0.3

(hereinafter referred to as the "zinciferous plated steel sheet No. 5 of the present invention").

In the zinciferous plated steel sheets Nos. 1 to 5 of the present invention, the metallic elements in the Fe—Ni—O film may comprise iron and nickel, and at least one selected from the group consisting of zinc, cobalt, manganese, chromium, molybdenum, aluminum, titanium, tin, tungsten, lead, niobium and tantalum, which are entrapped from that at least one zinciferous plating layer into the Fe—Ni—O film.

In accordance with one of the features of the present invention, there is provided a method for manufacturing the zinciferous plated steel sheet No. 1 of the present invention, which comprises the steps of:

subjecting a steel sheet to a zinciferous plating treatment to form at least one zinciferous plating layer on at least one surface of said steel sheet, and then, forming an Fe—Ni—O film as an uppermost layer on said at least one zinciferous plating layer by the use of an aqueous solution which contains iron chloride ($FeCl_2$) and nickel chloride ($NiCl_2$) and has a pH value within a range of from 2.0 to 3.5 and a temperature within a range of from 20° to 70° C.

(hereinafter referred to as the "first method of the present invention").

In accordance with one of the features of the present invention, there is provided a method for manufacturing the zinciferous plated steel sheet No. 2 of the present invention, in which the following limitations are added to the first method of the present invention:

a ratio of an iron content (g/l) relative to a total quantity of the iron content (g/l) and a nickel content (g/l) in said aqueous solution being limited within a range therefrom over 0 to 0.9

(hereinafter referred to as the "second method of the present invention").

In accordance with one of the features of the present invention, there is provided a method for manufacturing the zinciferous plated steel sheet No. 3 of the present invention, in which the following limitations are added to the first method of the present invention:

the ratio of the iron content (g/l) relative to the total quantity of the iron content (g/l) and the nickel content (g/l) in said aqueous solution being limited within a range of from 0.05 to under 1.0

(hereinafter referred to as the "third method of the present invention").

In accordance with one of the features of the present invention, there is provided a method for manufacturing the zinciferous plated steel sheet No. 4 of the present invention, in which the following limitations are added to the first method of the present invention:

the ratio of the iron content (g/l) relative to the total quantity of the iron content (g/l) and the nickel content (g/l) in said aqueous solution being limited within a range of from 0.05 to 0.9

(hereinafter referred to as the fourth method of the present invention").

In accordance with one of the features of the present invention, there is provided a method for manufacturing the zinciferous plated steel sheet No. 5 of the present invention, in which the following limitations are added to the first method of the present invention:

the ratio of the iron content (g/l) relative to the total quantity of the iron content (g/l) and the nickel content (g/l) in said aqueous solution being limited within a range of from 0.1 to 0.3

(hereinafter referred to as the "fifth method of the present invention").

In the first to fifth methods of the present invention, an aqueous solution containing an oxidizing agent may be used as said aqueous solution.

In the first to fifth methods of the present invention, the zinciferous plated steel sheet in which the Fe—Ni—O film is formed on that at least one zinciferous plating layer, may be heated to a temperature within a range of from 50° to 600° C. in an oxidizing atmosphere to adjust an oxygen content in the Fe—Ni—O film.

In the first to fifth methods of the present invention, the Fe—Ni—O film may first be formed on that at least one zinciferous plating layer by the use of an aqueous solution not containing an oxidizing agent, and then, an oxygen content in the Fe—Ni—O film may be adjusted by the use of another aqueous solution containing an oxidizing agent.

DETAILED DESCRIPTION OF THE PREFERRED EMBODIMENTS

Figure 1:
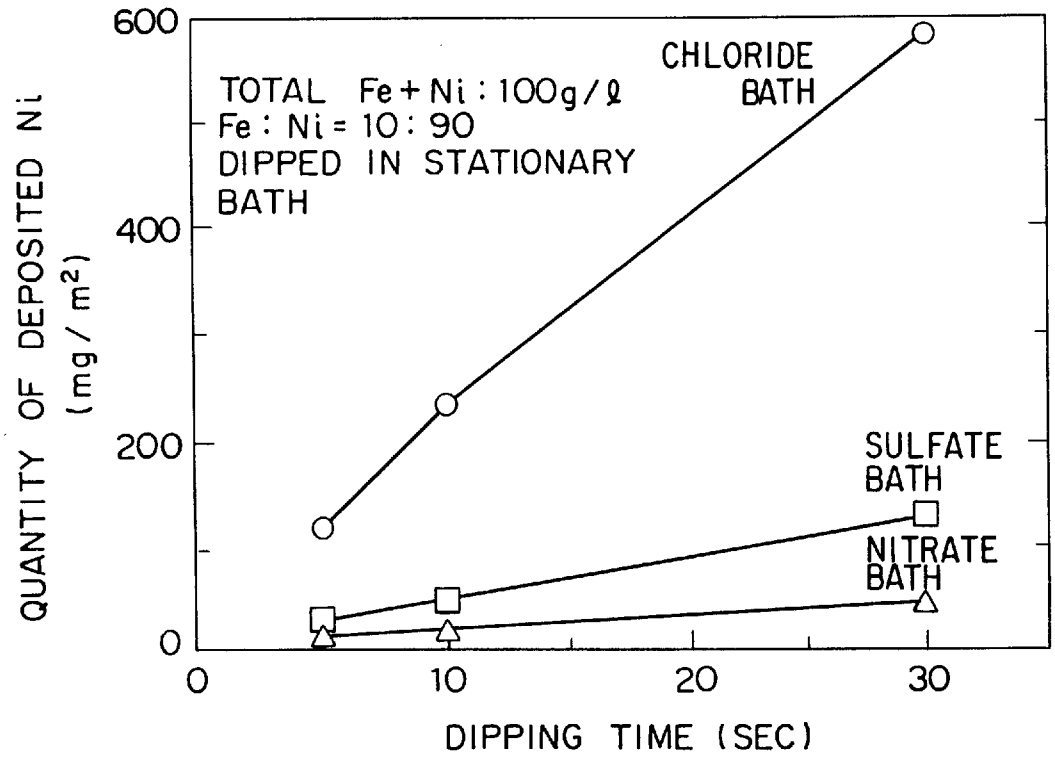
FIG. 1 is a graph illustrating a relationship, when forming an Fe—Ni—O film on a surface of a zinciferous plating layer of a zinciferous plated steel sheet by the use of an aqueous solution, between a quantity of nickel deposited on the surface of the zinciferous plating layer and a dipping time of the zinciferous plated steel sheet into the aqueous solution.

Extensive studies were carried out in order to solve the above-mentioned problems. As a result, it was found possible to improve press-formability, spot-weldability, adhesiveness and chemical treatability of a zinciferous plated steel sheet by appropriately forming an Fe—Ni—O film as an uppermost layer on a surface of a plating layer of the zinciferous plated steel sheet.

More specifically, a conventional zinciferous plated steel sheet is lower in press-formability as compared with a cold-rolled steel sheet. It is attributable to the fact that sliding resistance between the zinciferous plated steel sheet and a die of a press is larger than that between the cold-rolled steel sheet and the die of the press. The cause is that, under a high surface pressure, zinc having a low melting point sticks to the die. In order to prevent this inconvenience, it is an effective measure to form a film, which is harder than the zinciferous plating layer and has a melting point higher than that of the zinciferous plating layer, on the surface of the zinciferous plating layer of the zinciferous plated steel sheet. The Fe—Ni—O film in the present invention is harder than the zinciferous plating layer, and has a melting point higher than that of the zinciferous plating layer. Formation of the Fe—Ni—O film on the surface of the zinciferous plating layer of the zinciferous plated steel sheet therefore reduces sliding resistance against the die of the press during the press-forming, facilitates flowing of the zinciferous plated steel sheet into the die of the press, and thus, improves press-formability of the zinciferous plated steel sheet.

The conventional zinciferous plated steel sheet is lower in continuous spot-weldability as compared with the cold-rolled steel sheet. This is caused by the fact that, during the spot-welding, a tip of a copper electrode coming into contact with molten zinc melts and produces a brittle alloy phase, resulting in a serious deterioration of the electrode. Therefore, an effective measure for improving continuous spot-weldability during the spot-welding of the zinciferous plated steel sheet is believed to form a film having a high melting point on the surface of the zinciferous plating layer. As a result of studies on various films to improve spot-weldability of the zinciferous plated steel sheet, it was found that a nickel oxide film was particularly effective in this respect. Although the reason is not known in detail, conceivable ones are that a reaction between nickel and zinc produces a Zn—Ni alloy of a high melting point, and that, because of the very high melting point of nickel oxide and semiconducting properties thereof, the nickel oxide film has a particularly high electric conductivity among various films.

While it has commonly been known that the conventional zinciferous plated steel sheet is lower in adhesiveness as compared with the cold-rolled steel sheet, the cause has not as yet been clear. An investigation on the cause has elucidated dependency of adhesiveness upon a chemical composition of the oxide film formed on the surface of the zinciferous plating layer. More specifically, in the cold-rolled steel sheet, the oxide film on the surface thereof mainly comprises iron oxides, whereas, in the zinciferous plated steel sheet, the oxide film thereof mainly comprises zinc oxides. Adhesiveness varies with the chemical composition of the oxide film. That is, the zinc oxide film has a lower adhesiveness than the iron oxide film. It is therefore possible to improve adhesiveness of the zinciferous plated steel sheet by forming a film containing iron oxides on the surface of the zinciferous plating layer of the zinciferous plated steel sheet, as in the present invention.

The conventional zinciferous plated steel sheet has a lower chemical treatability than the cold-rolled steel sheet, because a high zinc concentration in the surface of the zinciferous plating layer of the zinciferous plated steel sheet leads to coarse and non-uniform crystal grains of a phosphate film formed, and the phosphate crystals have different properties. More specifically, when a zinc concentration in the surface of the zinciferous plating layer is high, an the crystals of the phosphate film mainly comprise hopeite ($zn_3(PO_4)_2 \cdot 4H_2O$), and therefore, the phosphate film is poor in hot-water secondary adhesiveness after painting. This is due to the fact that, because of a low iron concentration in the phosphate film, exposure to a damp environment after the painting causes the recovery of lost water in the phosphate film which loses adhesion to the steel sheet.

In order to inhibit the recovery of lost water in the phosphate film, it is an effective measure to add such metals as iron and nickel to the phosphate crystals. It has been cleared up the following facts that, by forming an Fe—Ni—O film on the surface of the zinciferous plating layer of the zinciferous plated steel sheet, as in the present invention, iron and nickel in the Fe—Ni—O film are entrapped into phosphate crystals during the chemical treatment such as a formation of the phosphate film, thus forming a phosphate film having a satisfactory adhesion, and forming dense and uniform phosphate crystal grains, hence improving not only hot-water secondary adhesion, but also corrosion resistance.

By appropriately forming the Fe—Ni—O film on the surface of the zinciferous plating layer of the zinciferous plated steel sheet, it is possible, as described above, to obtain a zinciferous plated steel sheet excellent in any of press-formability, spot-weldability, adhesiveness and chemical treatability.

Now, embodiments of the individual zinciferous plated steel sheets Nos. 1 to 5 of the present invention are described in detail.

Any one of the zinciferous plated steel sheets Nos. 1 to 5 of the present invention comprises a steel sheet, at least one zinciferous plating layer formed on at least one surface of the steel sheet, and an Fe—Ni—O film as an uppermost layer, formed on that at least one zinciferous plating layer.

In any one of the zinciferous plated steel sheets Nos. 1 to 5 of the present invention, a total quantity of metallic elements in the Fe—Ni—O film should be limited within a range of from 10 to 1,500 mg/m$^2$, and an oxygen content in the Fe—Ni—O film should be limited within a range of from 0.5 to under 30 wt. %.

By forming the Fe—Ni—O film on the surface of the zinciferous plating layer of the zinciferous plated steel sheet, press-formability, spot-weldability, adhesiveness and chemical treatability of the zinciferous plated steel sheet are improved, as described above. When, however, the total quantity of the metallic elements in the Fe—Ni—O film is under 10 mg/m$^2$ , no improving effect of press-formability, spot-weldability, adhesiveness and chemical treatability of the zinciferous plated steel sheet is available.

When the total quantity of the metallic elements in the Fe—Ni—O film is over 1,500 mg/m$^2$, on the other hand, the above-mentioned improving effect of press-formability, spot-weldability, adhesiveness and chemical treatability of the zinciferous plated steel sheet is saturated, and further, the production of phosphate crystals is inhibited, thus leading to degradation of chemical treatability of the zinciferous plated steel sheet. The total quantity of the metallic elements in the Fe—Ni—O film should therefore be limited within a range of from 10 to 1,500 mg/M$^2$. Particularly, in order to further improve chemical treatability, the total quantity of the metallic elements in the Fe—Ni—O film should preferably be limited within a range of from 10 to 1,200 mg/m$^2$.

In the present invention, the zinciferous plating layer formed on the surface of the steel sheet may contain, in addition to zinc, such metals as iron, nickel, cobalt, manganese, chromium, molybdenum, aluminum, titanium, tin, tungsten, lead, niobium and tantalum. When the Fe—Ni—O film is formed on the zinciferous plating layer, at least one of the metallic elements in the zinciferous plating layer may be entrapped into the Fe—Ni—O film. In such a case, the above-mentioned total quantity of the metallic elements in the Fe—Ni—O film includes not only the contents of iron and nickel but also the contents of the above-mentioned metallic elements entrapped from the zinciferous plating layer into the Fe—Ni—O film.

Oxides and/or hydroxides of the metallic elements, or silicon may be entrapped into the Fe—Ni—O film, but this never exerts an adverse effect on properties of the zinciferous plated steel sheet of the present invention.

In accordance with the above-mentioned reasons of limitation regarding the total quantity of the metallic elements in the Fe—Ni—O film, in each of the zinciferous plated steel sheets Nos. 1 to 4 of the present invention, the total quantity of the metallic elements in the Fe—Ni—O film is limited within a range of from 10 to 1,500 mg/m$^2$, and in the zinciferous plated steel sheet No. 5 of the present invention, the total quantity of the metallic elements in the Fe—Ni—O film is limited within a range of from 10 to 1,200 mg/m$^2$.

By adding oxygen in an appropriate quantity to the Fe—Ni—O film, press-formability and spot-weldability of the zinciferous plated steel sheet are improved. However, with an oxygen content in the Fe—Ni—O film of under 0.5 wt. %, metal properties of the Fe—Ni—O film become stronger, and the improving effect of press-formability and spot-weldability of the zinciferous plated steel sheet cannot be displayed.

When the oxygen content in the Fe—Ni—O film is 30 wt. % or over, on the other hand, the whole of the Fe—Ni—O film is composed of oxides, resulting in non-existence of metals in the element form in the Fe—Ni—O film. As a result, the essential requirement in the present invention is not satisfied, which is the existence of the composite film containing at least two metals of iron and nickel, and oxides thereof, i.e., the existence of the Fe—Ni—O film. The oxygen content in the Fe—Ni—O film should therefore be limited within a range of from 0.5 to under 30 wt. %.

The oxygen content in the Fe—Ni—O film exerts an effect on chemical treatability of the zinciferous plated steel sheet. More specifically, with an oxygen content in the Fe—Ni—O film of over 10 wt. %, the quantity of oxides in the Fe—Ni—O film becomes excessively large, and as a result, the production of phosphate crystals is inhibited, thus leading to degradation of chemical treatability. In order to impart an excellent chemical treatability to the zinciferous plated steel sheet, therefore, the oxygen content in the Fe—Ni—O film should be limited within a range of from 0.5 to 10 wt. %.

In accordance with the above-mentioned reasons of limitation regarding the oxygen content in the Fe—Ni—O film, in each of the zinciferous plated steel sheets Nos. 1 to 3 of the present invention, the oxygen content in the Fe—Ni—O film is limited within a range of from 0.5 to under 30 wt. %, and in each of the zinciferous plated steel sheets Nos. 4 and 5 of the present invention, the oxygen content in the Fe—Ni—O film is limited within a range of from 0.5 to 10 wt. %.

In the zinciferous plated steel sheet No. 1 of the present invention, particularly with a view to improving press-formability, it suffices to satisfy both of the above-mentioned limitation regarding the total quantity of the metallic elements in the Fe—Ni—O film, and the above-mentioned limitation regarding the oxygen content in the Fe—Ni—O film. Further, in the zinciferous plated steel sheets Nos. 2 to 5 of the present invention, a ratio of an iron content (wt. %) relative the iron content of the iron content (wt. %) and a nickel content (wt. %) in the Fe—Ni—O film (hereinafter referred to as the "ratio Fe/(Fe+Ni)") is limited within a range of from over 0 to under 1.0 in order to obtain an excellent spot-weldability and/or an excellent adhesiveness.

With a ratio Fe/(Fe+Ni) in the Fe—Ni—O film of 0 (zero), iron and oxides thereof are non-existent in the Fe—Ni—O film. As a result, the essential requirement in the present invention is not satisfied, which is the existence of the composite film containing at least two metals of iron and nickel, and oxides thereof, i.e., the existence of the Fe—Ni—O film. The ratio Fe/(Fe+Ni) in the Fe—Ni—O film should therefore be limited to over 0 (zero).

With a ratio Fe/(Fe+Ni) in the Fe—Ni—O film of over 0.9, on the other hand, the nickel content in the Fe—Ni—O film becomes relatively lower, and this makes it difficult to form a Zn—Ni alloy having a high melting point during the welding, leading as a result to more serious deterioration of the electrode during the spot-welding. The improving effect of spot-weldability of the zinciferous plated steel sheet is therefore unavailable.

In accordance with the above-mentioned reason of limitation regarding the ratio Fe/(Fe+Ni) in the Fe—Ni—O film, in the zinciferous plated steel sheet No. 2 of the present invention, the ratio Fe/(Fe+Ni) in the Fe—Ni—O film is limited within a range of from over 0 to 0.9 with a view to improving spot-weldability of the zinciferous plated steel sheet.

Iron in an appropriate quantity contained in the Fe—Ni—O film improves adhesiveness of the zinciferous plated steel sheet. More specifically, iron comes under the category of metals having the highest adhesiveness. Adhesiveness of the zinciferous plated steel sheet is therefore improved more according as the iron content in the Fe—Ni—O film becomes higher. With a ratio Fe/(Fe+Ni) in the Fe—Ni—O film of under 0.05%, however, the improving effect of adhesiveness of the zinciferous plated steel sheet is unavailable.

With a ratio Fe/(Fe+Ni) in the Fe—Ni—O film of 1.0, on the other hand, Ni would be non-existent in the Fe—Ni—O film. As a result, the essential requirement in the present invention is not satisfied, which is the existence of the composite film containing at least two metals of iron and nickel, and oxides thereof, i.e., the existence of the Fe—Ni—O film. The ratio Fe/(Fe+Ni) in the Fe—Ni—O film should therefore be limited to under 1.0.

In accordance with the above-mentioned reason of limitation regarding the ratio Fe/(Fe+Ni) in the Fe—Ni—O film, in the zinciferous plated steel sheet No. 3 of the present invention, the ratio Fe/(Fe+Ni) in the Fe—Ni—O film is limited within a range of from 0.05 to under 1.0 with a view to improving adhesiveness of the zinciferous plated steel sheet.

In accordance with the above-mentioned reason of limitation regarding the ratio Fe/(Fe+Ni) in the Fe—Ni—O film, in the zinciferous plated steel sheet No. 4 of the present invention, the ratio Fe/(Fe+Ni) in the Fe—Ni—O film is limited within a range of from 0.05 to 0.9 with a view to improving both of spot-weldability and adhesiveness of the zinciferous plated steel sheet.

By limiting the ratio Fe/(Fe+Ni) in the Fe—Ni—O film within a range of from 0.1 to 0.3, it is possible to further improve adhesiveness of the zinciferous plated steel sheet. In accordance with this reason, in the zinciferous plated steel sheet No. 5 of the present invention, the ratio Fe/(Fe+Ni) in the Fe—Ni—O film is limited within a range of from 0.1 to 0.3 with a view to improving spot-weldability and further improving adhesiveness.

The zinciferous plated steel sheet is required to be provided with prescribed properties depending upon the use, i.e., four properties including press-formability, spot-weldability, adhesiveness and chemical treatability. Therefore, the total quantity of the metallic elements, the oxygen content and the ratio Fe/(Fe+Ni) in the Fe—Ni—O film should appropriately be determined depending upon the use of the zinciferous plated steel sheet having the above-mentioned Fe—Ni—O film on the surface thereof. Requirements regarding the Fe—Ni—O film for obtaining the above-mentioned properties depending upon the use of the zinciferous plated steel sheet are summarized as follows:

(1) An excellent press-formability can be imparted to the zinciferous plated steel sheet by:
  (a) limiting the total quantity of the metallic elements in the Fe—Ni—O film within a range of from 10 to 1,500 mg/m$^2$; and
  (b) limiting the oxygen content in the Fe—Ni—O film within a range of from 0.5 to under 30 wt. %.

(2) An excellent press-formability and an excellent spot-weldability can be imparted to the zinciferous plated steel sheet by:
  (a) limiting the total quantity of the metallic elements in the Fe—Ni—O film within a range of from 10 to 1,500 mg/m$^2$;
  (b) limiting the oxygen content in the Fe—Ni—O film within a range of from 0.5 to under 30 wt. %; and
  (c) limiting the ratio Fe/(Fe+Ni) in the Fe—Ni—O film within a range of from over 0 to 0.9.

(3) An excellent press-formability and an excellent adhesiveness can be imparted to the zinciferous plated steel sheet by:
  (a) limiting the total quantity of the metallic elements in the Fe—Ni—O film within a range of from 10 to 1,500 mg/m$^2$;
  (b) limiting the oxygen content in the Fe—Ni—O film within a range of from 0.5 to under 30 wt. %; and
  (c) limiting the ratio Fe/(Fe+Ni) in the Fe—Ni—O film within a range of from 0.05 to under 1.0.

(4) An excellent press-formability, an excellent spot-weldability, an excellent adhesiveness and an excellent chemical treatability can be imparted to the zinciferous plated steel sheet by:
  (a) limiting the total quantity of the metallic elements in the Fe—Ni—O film within a range of from 10 to 1,500 mg/m$^2$;
  (b) limiting the oxygen content in the Fe—Ni—O film within a range of from 0.5 to 10 wt. %; and
  (c) limiting the ratio Fe/(Fe+Ni) in the Fe—Ni—O film within a range of from 0.05 to 0.9.

(5) A further excellent press-formability, an excellent spot-weldability, a further excellent adhesiveness and an excellent chemical treatability can be imparted to the zinciferous plated steel sheet by:
  (a) limiting the total quantity of the metallic elements in the Fe—Ni—O film within a range of from 10 to 1,200 mg/m$^2$;
  (b) limiting the oxygen content in the Fe—Ni—O film within a range of from 0.5 to 10 wt. %; and
  (c) limiting the ratio Fe/(Fe+Ni) in the Fe—Ni—O film within a range of from 0.1 to 0.3.

In the present invention, at least one of such conventional methods such as a dip-plating method, an electroplating method and a vapor-phase plating method is applied to a steel sheet to form a zinciferous plating layer on at least one surface of the steel sheet.

The zinciferous plating layer may comprise zinc only, or may contain, in addition to zinc such metals as iron, nickel, cobalt, manganese, chromium, molybdenum, aluminum, titanium, tin, tungsten, lead, niobium and tantalum, oxides thereof, silicon and various organic substances. The above-mentioned zinciferous plating layer may comprise a single layer comprising the above-mentioned ingredients, or may comprise a plurality of layers, each comprising the above-mentioned ingredients. Further, the zinciferous plating layer may contain fine particles of silica ($SiO_2$), alumina ($Al_2O_3$) or the like. The zinciferous plating layer may comprise a plurality of layers, each containing the same ingredients with different contents. Furthermore, the zinciferous plating layer may comprise a plurality of layers, each containing the same ingredients of which the contents sequentially vary in the thickness direction, known as "functional gradient plating layers."

The Fe—Ni—O film in the present invention is not limited by a forming method, but any of such conventional methods as a dipping-application method, a roll-application method, a spray-application method and a cathodic electrolytic treating method is applicable for the formation of the Fe—Ni—O film.

The above-mentioned Fe—Ni—O film is formed on the zinciferous plating layer formed on at least one surface of the zinciferous plated steel sheet. Depending upon a portion of the automobile body where the zinciferous plated steel sheet is to be used in the manufacturing step of the automobile body, the zinciferous plated steel sheet having the zinciferous plating layer and the Fe—Ni— O film on one surface thereof, or the zinciferous plated steel sheet having the zinciferous plating layer and the Fe—Ni—O film on each of the both surfaces thereof are appropriately selected for use.

Now, first to fifth methods of the present invention for manufacturing the zinciferous plated steel sheet are described in detail.

The first method of the present invention for manufacturing the zinciferous plated steel sheet No. 1 of the present invention comprises the step of: subjecting a steel sheet to a zinciferous plating treatment to form at least one zinciferous plating layer on at least one surface of the steel sheet, and then, forming an Fe—Ni—O film as an uppermost layer on that at least one zinciferous plating layer by the use of an aqueous solution which contains iron chloride ($FeCl_2$) and nickel chloride ($NiCl_2$) and has a pH value within a range of from 2.0 to 3.5 and a temperature within a range of from 20° to 70° C.

The second method of the present invention for manufacturing the zinciferous plated steel sheet No. 2 of the present invention comprises, in the first method of the present invention, limiting a ratio of an iron content (g/l) relative to a total quantity of the iron content (g/l) and a nickel content (g/l) in the aqueous solution within a range of from over 0 to 0.9.

The third method of the present invention for manufacturing the zinciferous plated steel sheet No. 3 of the present invention comprises, in the first method of the present invention, limiting the ratio of the iron content (g/l) relative to the total quantity of the iron content (g/l) and the nickel content (g/l) in the aqueous solution within a range of from 0.05 to under 1.0.

The fourth method of the present invention for manufacturing the zinciferous plated steel sheet No. 4 of the present invention comprises, in the first method of the present invention, limiting the ratio of the iron content (g/l) relative to the total quantity of the iron content (g/l) and the nickel content (g/l) in the aqueous solution within a range of from 0.05 to 0.9.

The fifth method of the present invention for manufacturing the zinciferous plated steel sheet No. 5 of the present invention comprises, in the first method of the present invention, limiting the ratio of the iron content (g/l) relative to the total quantity of the iron content (g/l) and the nickel content (g/l) in the aqueous solution within a range of from 0.1 to 0.3.

In any of the first to fifth methods of the present invention, a steel sheet is first subjected to a zinciferous plating treatment to form at least one zinciferous plating layer on at least one surface of the steel sheet. In this zinciferous plating treatment, at least one of such conventional methods as a dip-plating method, an electroplating method and a vapor-phase plating method is applied.

The zinciferous plating layer may comprise zinc only, or may contain, in addition to zinc such metals as iron, nickel, cobalt, manganese, chromium, molybdenum, aluminum, titanium, tin, tungsten, lead, niobium and tantalum, oxides thereof, silicon and various organic substances. The above-mentioned zinciferous plating layer may comprise a single layer comprising the above-mentioned ingredients, or may comprise a plurality of layers, each comprising the above-mentioned ingredients. Further, the zinciferous plating layer may contain fine particles of silica ($SiO_2$), alumina ($Al_2O_3$) or the like. The zinciferous plating layer may comprise a plurality of layers, each containing the same ingredients with different contents. Furthermore, the zinciferous plating layer may comprise a plurality of layers, each containing the same ingredients of which the contents sequentially vary in the thickness direction, known as "functional gradient plating layers."

Then, in any of the first to fifth methods of the present invention, an aqueous solution satisfying specific conditions is used to form an Fe—Ni—O film on at least one zinciferous plating layer described above.

In the first to fifth methods of the present invention, the aqueous solution used for forming the Fe—Ni—O film on the zinciferous plating layer of the zinciferous plated steel sheet (hereinafter referred to as the "film-forming aqueous solution") contains iron chloride ($FeCl_2$) and nickel chloride ($NiCl_2$). The reason is that the use of chloride as a metallic salt gives a high precipitation efficiency. More specifically, comparison of chloride as a metallic salt with nitrate and sulfate under the same concentration and the same treatment time reveals that the metallic salt as chloride results in larger quantities of deposited nickel and iron, thus permitting productivity improvement.

FIG. 1 is a graph illustrating a relationship, when forming an Fe—Ni—O film on a surface of a zinciferous plating layer of a zinciferous plated steel sheet by the use of a film-forming aqueous solution, between a quantity of nickel deposited on the surface of the zinciferous plating layer and a dipping time of the zinciferous plated steel sheet into the aqueous solution. When investigating the above-mentioned relationship, various film-forming aqueous solutions had a total quantity of an iron content and a nickel content of 100 g/l and a ratio of the iron content to the nickel content of 10:90. A steel sheet having a zinciferous plating layer on the surface thereof was dipped into various film-forming aqueous solutions in the stationary state. As is clear from FIG. 1, the chloride bath is far superior to the sulfate bath and the nitrate bath in the precipitation efficiency of nickel.

Any of such conventional methods as a dipping-application method, a roll-application method, a spray-application method and a cathodic electrolytic treating method is applied for the purpose of forming the Fe—Ni—O film using the film-forming aqueous solution.

By keeping the pH value of the film-forming aqueous solution within an appropriate range, it is possible to efficiently form the Fe—Ni—O film on the zinciferous plating layer. More specifically, with a pH value of under 2.0, an extremely large quantity of produced hydrogen in the film-forming aqueous solution leads to a low precipitation efficiency of iron and nickel. As a result, the quantity of deposited iron and nickel is small with a prescribed salt concentration and a prescribed dipping time, thus resulting in a reduced productivity. Furthermore, since the Fe—Ni—O film mostly comprises such metals as iron and nickel, there is unavailable the improving effect of press-formability, spot-weldability and adhesiveness of the zinciferous plated steel sheet. Even with a low pH value, it is possible to increase the quantity of deposited iron and nickel per unit time by increasing the salt concentration. This however leads to undesirable problems such as a high cost for the film-forming aqueous solution and a large quantity of produced sludge in the aqueous solution. With a pH value of over 3.5, on the other hand, oxidation of iron in the film-forming aqueous solution becomes serious and sludge causes surface defects of the zinciferous plated steel sheet.

Figure 2:
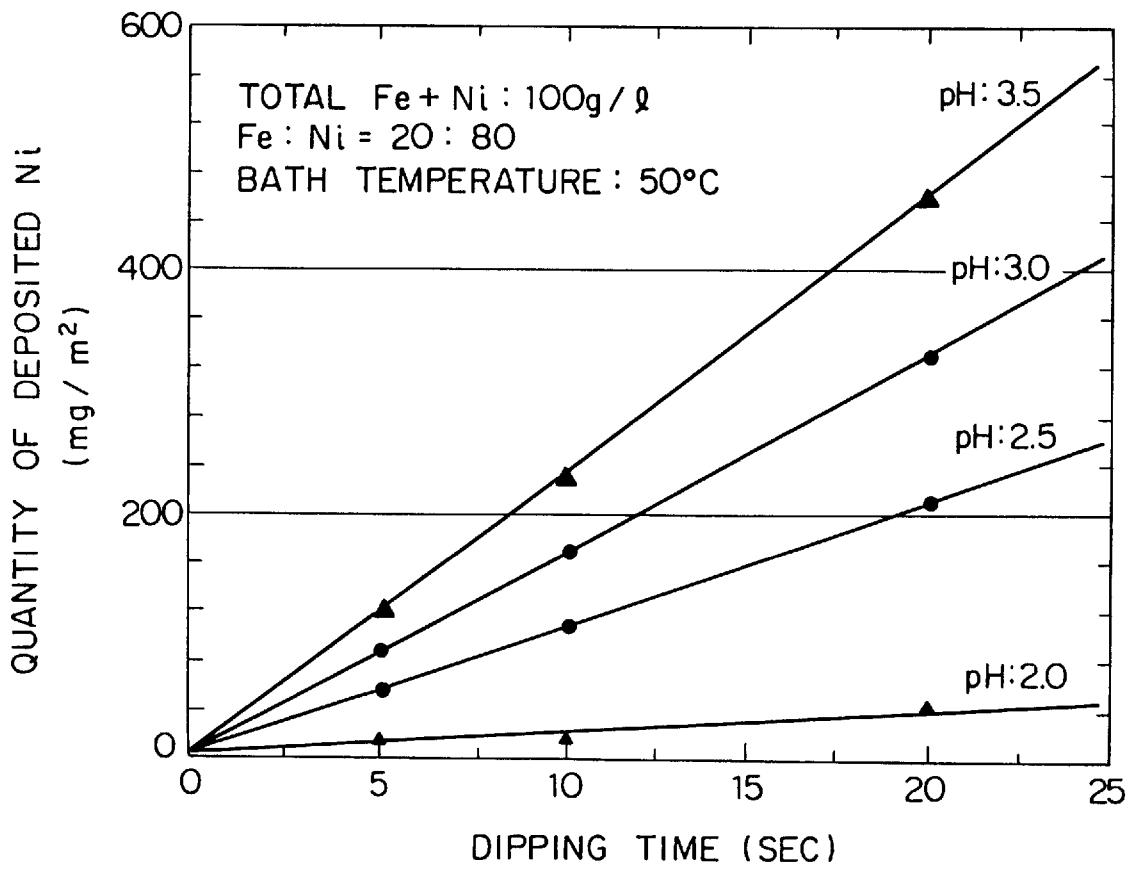
FIG. 2 is a graph illustrating a relationship, when forming an Fe—Ni—O film on a surface of a zinciferous plating layer of a zinciferous plated steel sheet by the use of a chloride bath as an aqueous solution, between a quantity of nickel deposited onto the surface of the zinciferous plating layer and a dipping time of the zinciferous plated steel sheet into the chloride bath, for each of different values of pH of the chloride bath.

FIG. 2 is a graph illustrating a relationship, when forming an Fe—Ni—O film on a surface of a zinciferous plating layer of a zinciferous plated steel sheet by the use of a chloride bath as a film-forming aqueous solution, between a quantity of nickel deposited onto the surface of the zinciferous plating layer and a dipping time of the zinciferous plated steel sheet into the chloride bath, for each of difference values of pH within a range of from 2.0 to 3.5 of the chloride bath. When investigating the above-mentioned relationship, the chloride bath had a total quantity of an iron content and a nickel content of 100 g/l, a ratio of the iron content to the nickel content (g/l) of 20:80, and a bath temperature of 50° C. As is clear from FIG. 2, along with the increase in the dipping time, and along with the increase in the pH value within a range of from 2.0 to 3.5, the quantity of deposited nickel increases, hence the quantity of deposited Fe—Ni—O film increases.

In the first to fifth methods of the present invention, therefore, the pH value of the film-forming aqueous solution should be limited within a range of from 2.0 to 3.5.

Increasing the temperature of the film-forming aqueous solution increases a reaction speed and improves the precipitation efficiency of iron and nickel, resulting in an improved productivity. With a temperature of the film-forming aqueous solution of under 20° C., the reaction speed is low, and achievement of the total quantity of the metallic elements in the Fe—Ni—O film, particularly the total quantity of iron and nickel, which is necessary for the property improvement of the zinciferous plated steel sheet, requires a long period of time, thus reducing productivity. With a temperature of the film-forming aqueous solution of over 70° C., on the other hand, deterioration of the film-forming aqueous solution proceeds more rapidly, and sludge is produced in the film-forming aqueous solution. In addition, facilities and a heat energy source are required for keeping the film-forming aqueous solution at a high temperature, and this results in a higher manufacturing cost.

The temperature of the film-forming aqueous solution in the first to fifth methods of the present invention should therefore be limited within a range of from 20° to 70° C.

As is clear from the above description of the zinciferous plated steel sheets Nos. 1 to 5 of the present invention, the total quantity of the metallic elements in the Fe—Ni—O film exerts an effect on press-formability, spot-weldability, adhesiveness and chemical treatability of the zinciferous plated steel sheet. With this fact in view, in the zinciferous plated steel sheets Nos. 1 to 4 of the present invention, the total quantity of the metallic elements in the Fe—Ni—O film is limited within a range of from 10 to 1,500 $mg/m^2$, and in the zinciferous plated steel sheet No. 5 of the present invention, the total quantity of the metallic elements in the Fe—Ni—O film is limited within a range of from 10 to 1,200 $mg/m^2$.

As is evident from the above description of the zinciferous plated steel sheets Nos. 2 to 5 of the present invention, the ratio Fe/(Fe+Ni) in the Fe—Ni—O film exerts an effect on spot-weldability and adhesiveness of the zinciferous plated steel sheet. With this fact in view, in the zinciferous plated steel sheet No. 2 of the present invention, the ratio Fe/(Fe+Ni) in the Fe—Ni—O film is limited within a range of from over 0 to 0.9. In order to maintain the ratio Fe/(Fe+Ni) in the Fe—Ni—O film within the range of from over 0 to 0.9, it suffices to keep a ratio of an iron content (g/l) relative to a total quantity of the iron content (g/l) and a nickel content (g/l) (Fe/(Fe+Ni)) in the film-forming aqueous solution within a range of from over 0 to 0.9.

In the zinciferous plated steel sheet No. 3 of the present invention, the ratio Fe/(Fe+Ni) in the Fe—Ni—O film is limited within a range of from 0.05 to under 1.0. In order to maintain the ratio Fe/(Fe+Ni) in the Fe—Ni—O film within the range of from 0.05 to under 1.0, it suffices to keep a ratio of an iron content (g/l) relative to a total quantity of the iron content (g/l) and a nickel content (g/l) (Fe/(Fe+Ni)) in the film-forming aqueous solution within a range of from 0.05 to under 1.0.

In the zinciferous plated steel sheet No. 4 of the present invention, the ratio Fe/(Fe+Ni) in the Fe—Ni—O film is limited within a range of from 0.05 to 0.9. In order to maintain the ratio Fe/(Fe+Ni) in the Fe—Ni—O film within the range of from 0.05 to 0.9, it suffices to keep a ratio of an iron content (g/l) relative to a total quantity of the iron content (g/l) and a nickel content (g/l) (Fe/(Fe+Ni)) in the film-forming aqueous solution within a range of from 0.05 to 0.9.

In the zinciferous plated steel sheet No. 5 of the present invention, the ratio Fe/(Fe+Ni) in the Fe—Ni—O film is limited within a range of from 0.1 to 0.3. In order to maintain the ratio Fe/(Fe+Ni) in the Fe—Ni—O film within a range of from 0.1 to 0.3, it suffices to keep a ratio of an iron content (g/l) relative to a total quantity of the iron content (g/l) and a nickel content (g/l) (Fe/(Fe+Ni)) in the film-forming aqueous solution (Fe/(Fe+Ni)) within a range of from 0.1 to 0.3.

As is clear from the above description of the zinciferous plated steel sheets Nos. 1 to 5 of the present invention, the oxygen content in the Fe—Ni—O film exerts an effect on press-formability, spot-weldability and chemical treatability of the zinciferous plated steel sheet. With this fact in view, in the zinciferous plated steel sheets Nos. 1 to 3 of the present invention, the oxygen content in the Fe—Ni—O film is limited within a range of from 0.5 to under 30 wt. %, and in the zinciferous plated steel sheets Nos. 4 and 5 of the present invention, the oxygen content in the Fe—Ni—O film is limited within a range of from 0.5 to 10 wt. %.

In the first to fifth methods of the present invention, adjustment of the oxygen content in the Fe—Ni—O film is achieved by adjusting a pH value of the film-forming aqueous solution, by adding an oxidizing agent to the film-forming aqueous solution, and/or by heating the zinciferous plated steel sheet having the Fe—Ni—O film formed on the zinciferous plating layer thereof in an oxidizing atmosphere.

Applicable oxidizing agents to be added to the film-forming aqueous solution include, for example, nitric acid ions, nitrous acid ions, chloric acid ions, bromic acid ions, a hydrogen peroxide solution and potassium permanganate. While it suffices to use at least one of these oxidizing agents, the total quantity of added oxidizing agents should preferably be within a range of from 0.1 to 50 g/l.

When heating the zinciferous plated steel sheet having the Fe—Ni—O film formed on the zinciferous plating layer thereof in an oxidizing atmosphere, a heating temperature should preferably be within a range of from 50° to 600° C. This heating treatment is conducted, for example, in the open air, or in a gas containing oxygen and/or ozone in an amount of at least 20 vol.%.

Further in the first to fifth methods of the present invention, an Fe—Ni—O film may first be formed by the use of a film-forming aqueous solution not containing any of the above-mentioned oxidizing agents, and then, an oxygen content in the Fe—Ni—O film may be adjusted by the use of another aqueous solution containing any of the above-mentioned oxidizing agents. The quantity of added oxidizing agent as described above should preferably be within a range of from 0.1 to 50 g/l.

The film-forming aqueous solution may contain cations of such metals as zinc, cobalt, manganese, chromium, molybdenum, aluminum, titanium, tin, tungsten, lead, niobium and tantalum, which are contained in the zinciferous plating layer, oxides and hydroxides of these metals, silicon and anions other than chloric acid ions.

Now, the zinciferous plated steel sheet of the present invention excellent in press-formability and the method for manufacturing same of the present invention are described further in detail by means of examples while comparing with examples for comparison.

EXAMPLE 1

First, each of the steel sheets was subjected to a zinciferous plating treatment to form a zinciferous plating layer on each of the both surfaces of the steel sheet, thereby preparing a zinciferous plated steel sheet (hereinafter referred to as the "substrate sheet"). The thus prepared substrate sheets comprised the following seven kinds of zinciferous plated steel sheet:

(1) GA: an alloying-treated zinc dip-plated steel sheet having a zinciferous plating layer which consists essentially of 10 wt. % iron and the balance being zinc, and has a plating weight of 60 g/m$^2$ per surface on each of the both surfaces thereof;

(2) GI: a zinc dip-plated steel sheet having a zinc plating layer which consists essentially of zinc, and has a plating weight of 90 g/m$^2$ per surface on each of the both surfaces thereof;

(3) EG: a zinc electroplated steel sheet having a zinc plating layer which consists essentially of zinc, and has a plating weight of 40 g/m$^2$ per surface on each of the both surfaces thereof;

(4) Zn—Fe: a Zn—Fe alloy electroplated steel sheet having a zinciferous plating layer which consists essentially of 15 wt. % iron and the balance being zinc, and has a plating weight of 40 g/m$^2$ per surface on each of the both surfaces thereof;

(5) Zn—Ni: a Zn—Ni alloy electroplated steel sheet having a zinciferous plating layer which consists essentially of 12 wt. % nickel and the balance being zinc, and has a plating weight of 30 g/m$^2$ per surface on each of the both surfaces thereof;

(6) Zn—Cr: a Zn—Cr alloy electroplated steel sheet having a zinciferous plating layer which consists essentially of 4 wt. % chromium and the balance being zinc, and has a plating weight of 20 g/m$^2$ per surface on each of the both surfaces thereof;

(7) Zn—Al: a Zn—Al alloy dip-plated steel sheet having a zinciferous plating layer which consists essentially of 5 wt. % aluminum and the balance being zinc, and has a plating weight of 60 g/m$^2$ per surface on each of the both surfaces thereof.

On each of the zinciferous plating layers of the thus prepared substrate sheets, an Fe—Ni—O film was formed by any of the following three forming methods "A" to "C".

Forming method "A"The substrate sheet was subjected to a cathodic electrolytic treatment in a mixed aqueous solution of iron sulfate and nickel sulfate containing an oxidizing agent, to form an Fe—Ni—O film on the both surfaces of the substrate sheet, i.e., on each of the zinciferous plating layers thereof. In this treatment, the nickel sulfate content was kept at 100 g/l while changing the iron sulfate content to various values, and keeping a pH value of 2.5 and a bath temperature of 50° C. Hydrogen peroxide solution was used as the above-mentioned oxidizing agent, and the content of oxidizing agent was changed to various values to adjust the oxygen content in the Fe—Ni—O film.

Forming method "B"An aqueous solution containing nickel chloride in an amount of 120 g/l and iron chloride in any of various amounts, was sprayed onto the both surfaces of the substrate sheet, i.e., onto each of the zinciferous plating layers thereof, to form an Fe—Ni—O film on each of the zinciferous plating layers. Then, the thus formed Fe—Ni—O film was dried in a mixed gas atmosphere of air and ozone while adjusting the oxygen content in the Fe—Ni—O film, thereby forming the Fe—Ni—O film having an adjusted oxygen content on each of the zinciferous plating layers of the substrate sheet.

Forming method "C"Each of the substrate sheets was dipped into an aqueous solution containing nickel chloride in an amount of 120 g/l and iron chloride in any of various amounts and having a pH value within a range of from 2.5 to 35 and a bath temperature of 50° C., to form an Fe—Ni—O film on each of the zinciferous plating layers of the substrate sheet. In this treatment, the quantity of deposit of the Fe—Ni—O film was changed to various values by adjusting the dipping time. The oxygen content in the Fe—Ni—O film was changed to various values by adjusting the pH value. The oxygen content was adjusted by appropriately adding an oxidizing agent to the aqueous solution or by conducting a heating treatment in an oxidizing atmosphere.Zinciferous plated steel sheets within the scope of the present invention (hereinafter referred to as the "samples of the invention") Nos. 1 to 52, and zinciferous plated steel sheets outside the scope of the present invention (hereinafter referred to as the "samples for comparison") Nos. 1 to 15 were prepared by subjecting the above-mentioned substrate sheets to any of the forming methods "A" to "C" described above. For each of the above-mentioned samples of the invention and samples for comparison, a total quantity of metallic elements, a ratio Fe/(Fe+Ni) and an oxygen content in the Fe—Ni—O film were measured by the following methods.

Measuring method of total quantity of metallic elements and ratio Fe/(Fe+Ni) in Fe—Ni—O filmFor each of the samples prepared from any of the substrate sheets GI, EG, Zn—Cr and Zn—Al, the Fe—Ni—O film and a surface portion of the zinciferous plating layer were dissolved for peeloff by means of diluted hydrochloric acid, and then, iron, nickel and other metallic elements contained in the resultant dissolution-peeled-off matter were quantitatively analyzed by the application of the ICP method (abbreviation of Inductively Coupled Plasma Spectroscopic method) to investigate individual metallic elements and quantities thereof in the Fe—Ni—O film. The total quantity of the metallic elements and the ratio Fe/(Fe+Ni) in the Fe—Ni—O film were determined on the basis of the results of such analysis.For each of the samples prepared from any of the substrate sheets GA, Zn—Fe and Zn—Ni, in which the zinciferous plating layer thereof contained constituent elements of the Fe—Ni—O films, it was difficult to completely separate constituent elements in the Fe—Ni—O film from those in the zinciferous plating layer by the ICP method. Therefore, only the constituent elements which were not contained in the zinciferous plating layer but were contained in the Fe—Ni—O film, were quantitatively analyzed by the application of the ICP method. Then, ion-sputtering by means of an argon gas was applied, and then, constituent elements in the Fe—Ni—O film were measured from the surface thereof in accordance with the XPS method (abbreviation of X-ray Photoelectron Spectroscopic method). A composition distribution of each of the constituent elements corresponding to a depth of the Fe—Ni—O film, was measured by repeating the steps mentioned above. In this measurement, a thickness of the Fe—Ni—O film was assumed to be represented by a difference between a depth corresponding to a position where a concentration of the constituent elements which were not contained in the zinciferous plating layer but were contained in the Fe—Ni—O film becomes maximum, on the one hand, and a depth corresponding to a position where these constituent elements were no more detected, on the other hand. The total quantity of the metallic elements and the ratio Fe/(Fe+Ni) in the Fe—Ni—O film were determined from the results of the ICP method and the XPS method.

Measuring method of oxygen content in Fe—Ni—O filmAn oxygen content in the Fe—Ni—O film was determined from the results of analysis in the depth direction of the Fe—Ni—O film by the application of the AES method (abbreviation of Auger Electron Spectroscopic method).

For each of the samples of the invention Nos. 1 to 52 and the samples for comparison Nos. 1 to 15, the kind of the substrate sheet, the forming method of the Fe—Ni—O film, the total quantity of the metallic elements in the Fe—Ni—O film, the ratio Fe/(Fe+Ni) in the Fe—Ni—O film, and the oxygen content in the Fe—Ni—O film are shown in Tables 1 to 3.

TABLE 1

| No. | Kind of substrate sheet | Fe—Ni—O film: Forming method | Total quantity of metallic elements ($mg/m^2$) | Fe / Fe + Ni | Oxygen content (wt. %) | Press-formability Coefficient of friction (bead "A") ($\mu$) | Spot-weldability Number of continuous spot-welding runs | Adhesiveness Peeloff strength (kgf/25 mm) | Chemical treatability State of crystals of chemically formed film |
|---|---|---|---|---|---|---|---|---|---|
| Sample of the Invention | | | | | | | | | |
| 1 | GA | A | 25 | 0.35 | 2.3 | 0.121 | ≧5000 | 13.5 | ○ |
| 2 | GA | A | 255 | 0.08 | 2.5 | 0.124 | ≧5000 | 12.5 | ○ |
| 3 | GA | A | 305 | 0.34 | 0.8 | 0.120 | ≧5000 | 13.4 | ○ |
| 4 | GA | A | 284 | 0.41 | 3.8 | 0.122 | ≧5000 | 13.7 | ○ |
| 5 | GA | A | 320 | 0.36 | 8.9 | 0.120 | ≧5000 | 13.5 | ○ |
| 6 | GA | A | 264 | 0.78 | 2.9 | 0.126 | ≧5000 | 14.8 | ○ |
| 7 | GA | A | 290 | 0.20 | 10.2 | 0.119 | ≧5000 | 13.5 | x |
| 8 | GA | A | 295 | 0.22 | 15.4 | 0.121 | ≧5000 | 13.5 | x |
| 9 | GA | A | 300 | 0.50 | 20.6 | 0.120 | ≧5000 | 13.9 | x |
| 10 | GA | C | 305 | 0.70 | 25.3 | 0.121 | ≧5000 | 14.2 | x |
| 11 | GA | A | 310 | 0.85 | 28.2 | 0.118 | ≧5000 | 14.8 | x |
| 12 | GA | A | 670 | 0.20 | 2.2 | 0.119 | ≧5000 | 13.5 | ○ |
| 13 | GA | A | 710 | 0.15 | 0.7 | 0.118 | ≧5000 | 13.5 | ○ |
| 14 | GA | A | 714 | 0.25 | 2.3 | 0.121 | ≧5000 | 13.7 | ○ |
| 15 | GA | A | 843 | 0.40 | 7.5 | 0.126 | ≧5000 | 14.0 | ○ |
| 16 | GA | C | 748 | 0.30 | 3.3 | 0.125 | ≧5000 | 12.9 | ○ |
| 17 | GA | A | 1309 | 0.20 | 2.9 | 0.124 | ≧5000 | 12.8 | ○ |
| 18 | GA | B | 49 | 0.29 | 1.5 | 0.121 | ≧5000 | 13.5 | ○ |
| 19 | GA | B | 197 | 0.09 | 2.3 | 0.120 | ≧5000 | 13.3 | ○ |
| 20 | GA | B | 206 | 0.40 | 0.6 | 0.118 | ≧5000 | 13.0 | ○ |
| 21 | GA | B | 225 | 0.43 | 3.8 | 0.116 | ≧5000 | 13.1 | ○ |
| 22 | GA | B | 215 | 0.48 | 9.1 | 0.128 | ≧5000 | 13.4 | ○ |
| 23 | GA | C | 613 | 0.35 | 2.1 | 0.124 | ≧5000 | 12.5 | ○ |
| 24 | GA | B | 1280 | 0.36 | 2.2 | 0.123 | ≧5000 | 12.9 | ○ |
| 25 | GI | A | 236 | 0.15 | 2.3 | 0.126 | 4000 | 13.5 | ○ |
| 26 | GI | A | 860 | 0.59 | 2.6 | 0.125 | 4000 | 12.4 | ○ |

TABLE 2

| No. | Kind of substrate sheet | Fe—Ni—O film: Forming method | Total quantity of metallic elements ($mg/m^2$) | Fe / Fe + Ni | Oxygen content (wt. %) | Press-formability Coefficient of friction (bead "A") ($\mu$) | Spot-weldability Number of continuous spot-welding runs | Adhesiveness Peeloff strength (kgf/25 mm) | Chemical treatability State of crystals of chemically formed film |
|---|---|---|---|---|---|---|---|---|---|
| Sample of the Invention | | | | | | | | | |
| 27 | GI | B | 284 | 0.68 | 1.8 | 0.118 | 4000 | 12.6 | ○ |
| 28 | GI | B | 872 | 0.26 | 0.7 | 0.120 | 4000 | 13.4 | ○ |
| 29 | EG | A | 34 | 0.35 | 2.3 | 0.125 | ≧5000 | 12.7 | ○ |
| 30 | EG | A | 254 | 0.08 | 2.5 | 0.123 | ≧5000 | 12.7 | ○ |
| 31 | EG | A | 264 | 0.36 | 0.7 | 0.122 | ≧5000 | 13.8 | ○ |
| 32 | EG | B | 249 | 0.38 | 2.5 | 0.127 | ≧5000 | 14.0 | ○ |
| 33 | EG | B | 247 | 0.34 | 8.8 | 0.124 | ≧5000 | 12.6 | ○ |
| 34 | EG | C | 284 | 0.78 | 2.3 | 0.123 | ≧5000 | 12.9 | ○ |
| 35 | EG | A | 879 | 0.35 | 2.4 | 0.121 | ≧5000 | 13.5 | ○ |
| 36 | EG | A | 1480 | 0.41 | 1.9 | 0.118 | ≧5000 | 12.6 | ○ |
| 37 | Zn—Fe | A | 268 | 0.40 | 2.8 | 0.125 | ≧5000 | 12.8 | ○ |
| 38 | Zn—Fe | B | 309 | 0.84 | 5.1 | 0.127 | ≧5000 | 12.8 | ○ |
| 39 | Zn—Fe | B | 976 | 0.26 | 1.8 | 0.125 | ≧5000 | 13.4 | ○ |
| 40 | Zn—Ni | B | 150 | 0.16 | 4.8 | 0.124 | ≧5000 | 13.1 | ○ |
| 41 | Zn—Ni | B | 770 | 0.35 | 1.4 | 0.120 | ≧5000 | 13.1 | ○ |
| 42 | Zn—Cr | A | 256 | 0.31 | 2.4 | 0.123 | ≧5000 | 13.6 | ○ |
| 43 | Zn—Cr | A | 1025 | 0.29 | 1.9 | 0.124 | ≧5000 | 12.8 | ○ |
| 44 | Zn—Al | B | 261 | 0.39 | 3.1 | 0.119 | 4500 | 12.9 | ○ |
| 45 | Zn—Al | C | 826 | 0.27 | 3.8 | 0.124 | 4500 | 13.1 | ○ |
| 46 | GA | A | 180 | 0.04 | 2.5 | 0.126 | ≧5000 | 7.9 | ○ |
| 47 | GA | A | 238 | 0.91 | 3.4 | 0.122 | 1900 | 13.7 | ○ |
| 48 | GA | B | 308 | 0.45 | 10.9 | 0.121 | ≧5000 | 13.4 | x |
| 49 | EG | B | 220 | 0.03 | 2.6 | 0.127 | ≧5000 | 4.9 | ○ |

TABLE 2-continued

| No. | Kind of substrate sheet | Fe—Ni—O film: Forming method | Total quantity of metallic elements ($mg/m^2$) | Fe / Fe + Ni | Oxygen content (wt. %) | Press-formability Coefficient of friction (bead "A") ($\mu$) | Spot-weldability Number of continuous spot-welding runs | Adhesiveness Peeloff strength (kgf/25 mm) | Chemical treatability State of crystals of chemically formed film |
|---|---|---|---|---|---|---|---|---|---|
| 50 | EG | A | 306 | 0.95 | 3.5 | 0.126 | 2300 | 13.1 | ○ |
| 51 | EG | B | 356 | 0.42 | 11.4 | 0.126 | ≧5000 | 13.1 | x |
| 52 | Zn—Al | B | 481 | 0.93 | 3.4 | 0.128 | 1600 | 12.6 | ○ |

TABLE 3

| No. | Kind of substrate sheet | Fe—Ni—O film: Forming method | Total quantity of metallic elements ($mg/m^2$) | Fe / Fe + Ni | Oxygen content (wt. %) | Press-formability Coefficient of friction (bead "A") ($\mu$) | Spot-weldability Number of continuous spot-welding runs | Adhesiveness Peeloff strength (kgf/25 mm) | Chemical treatability State of crystals of chemically formed film |
|---|---|---|---|---|---|---|---|---|---|
| Sample for Comparison | | | | | | | | | |
| 1 | GA | — | — | — | — | 0.187 | 1500 | 5.6 | Δ |
| 2 | GI | — | — | — | — | 0.205 | 800 | 3.5 | Δ |
| 3 | EG | — | — | — | — | 0.223 | 2200 | 4.1 | Δ |
| 4 | Zn—Fe | — | — | — | — | 0.154 | 3000 | 4.1 | Δ |
| 5 | Zn—Ni | — | — | — | — | 0.138 | 3500 | 4.9 | Δ |
| 6 | Zn—Cr | — | — | — | — | 0.145 | 3500 | 8.1 | Δ |
| 7 | Zn—Al | — | — | — | — | 0.167 | 1000 | 1.6 | Δ |
| 8 | GA | A | 8 | 0.35 | 5.3 | 0.179 | 1500 | 5.9 | Δ |
| 9 | GA | A | 6 | 0.84 | 1.6 | 0.191 | 1700 | 6.1 | Δ |
| 10 | GA | B | 1780 | 0.26 | 2.1 | 0.123 | ≧5000 | 12.9 | x |
| 11 | GA | B | 245 | 0.37 | 0.4 | 0.167 | 2000 | 13.4 | ○ |
| 12 | EG | A | 7 | 0.34 | 4.2 | 0.209 | 2300 | 4.5 | Δ |
| 13 | EG | B | 1800 | 0.29 | 2.3 | 0.128 | ≧5000 | 12.9 | x |
| 14 | EG | A | 294 | 0.34 | 0.3 | 0.210 | 2500 | 13.3 | ○ |
| 15 | Zn—Al | A | 6 | 0.38 | 2.8 | 0.164 | 1300 | 3.1 | Δ |

For each of the samples of the invention Nos. 1 to 52 and the samples for comparison Nos. 1 to 15, tests were carried out on press-formability, spot-weldability, adhesiveness and chemical treatability. Press-formability was evaluated on the basis of a coefficient of friction between a sample and a bead of an apparatus for measuring a coefficient of friction. Spot-weldability was evaluated on the basis of the number of continuous spot-welding runs. Adhesiveness was evaluated on the basis of peeloff strength after adhering the surfaces of the samples together. Chemical treatability was evaluated on the basis of a state of formation of phosphate crystal. These tests were carried out as follows:

Measuring test of coefficient of friction

For the purpose of evaluating press-formability, a coefficient of friction for each sample was measured with a measuring apparatus of a coefficient of friction.

Figure 3:
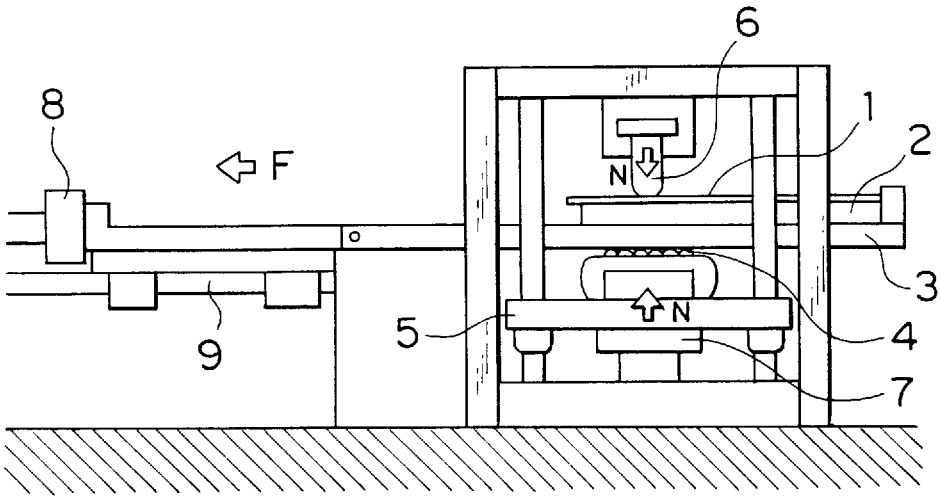
FIG. 3 is a schematic front view illustrating a measuring apparatus of a coefficient of friction.

FIG. 3 is a schematic front view illustrating a measuring apparatus of a coefficient of friction. As shown in FIG. 3, a sample 1 is fixed on a stand 2 which is secured to the upper surface of a sliding table 3 horizontally movable along a rail 9. Under the sliding table 3, a vertically movable supporting table 5 having a plurality of rollers 4 in contact with the sliding table 3 is provided. A first load cell 7 for measuring a pressing load N imparted by a bead 6 onto the sample 1, is attached to the supporting table 5. A second load cell 8 for measuring a sliding resistance F for causing the sliding table 3 to travel horizontally, is attached to an end of the sliding table 3. When carrying out a press-formability test, "NOX RUST 550 HN" made by Nihon Perkerizing Co., Ltd. was applied onto the upper surface of the sample 1 as a lubricant oil.

A coefficient of friction $\mu$ between the sample 1 and the bead 6 was calculated in accordance with the following formula:

$$\mu = F/N$$

In this calculation, the pressing load N was 400 kgf, and a pulling speed of the sample 1 (i.e., the horizontal traveling speed of the sliding table 3) was 100 cm/minute.

Figure 4:
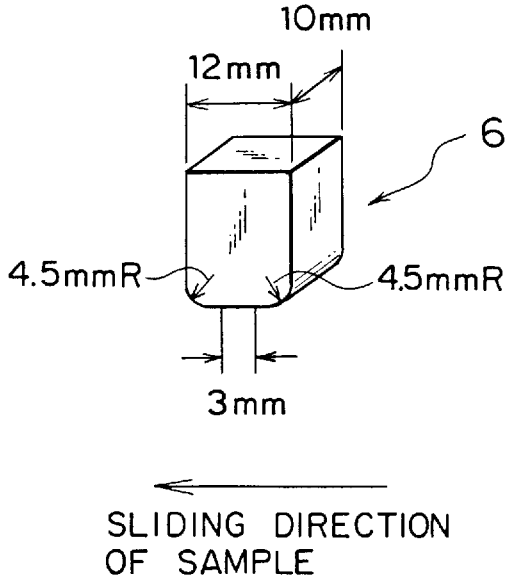
FIG. 4 is a schematic perspective view illustrating a bead of the measuring apparatus of a coefficient of friction.

FIG. 4 is a schematic perspective view of the bead 6 of the measuring apparatus of a coefficient of friction. The sample 1 slides in a state in which a lower end of the bead 6 is pressed against the upper surface of the sample 1. The lower end of the bead 6 has a flat face having a width of 10 mm and a length of 3 mm in the sliding direction, and the front and rear portions of this lower end are chamfered with a radius of 4.5 mm. The bead of this type is hereinafter referred to as the bead "A".

Continuous spot-weldability test

A continuous spot-weldability test was carried out for each sample to evaluate spot-weldability.

The test comprised piling two samples one on top of the other, nipping the thus piled two samples between a pair of electrode chips, and electrifying the two piled samples while applying a pressure to same, thereby continuously carrying out a resistance-welding with a concentrated welding current, i.e., a spot-welding, under the following welding conditions:

Electrode chip: a dome-type electrode chip having a diameter of 6 mm at the tip thereof;

Pressing force: 250 kgf;

Welding time: 0.2 seconds;

Welding current: 11.0 kiloampere (kA);

Welding speed: one spot/second.

Continuous spot-weldability was evaluated in terms of the number of continuous spot-welding runs performed before the diameter of a metallic portion having melted and solidified (hereinafter referred to as the "nugget") produced in a weld zone between the two piled samples during spot-welding become under $4\times t^{1/2}$ (t: thickness of a sample).

Adhesiveness test

Figure 5:
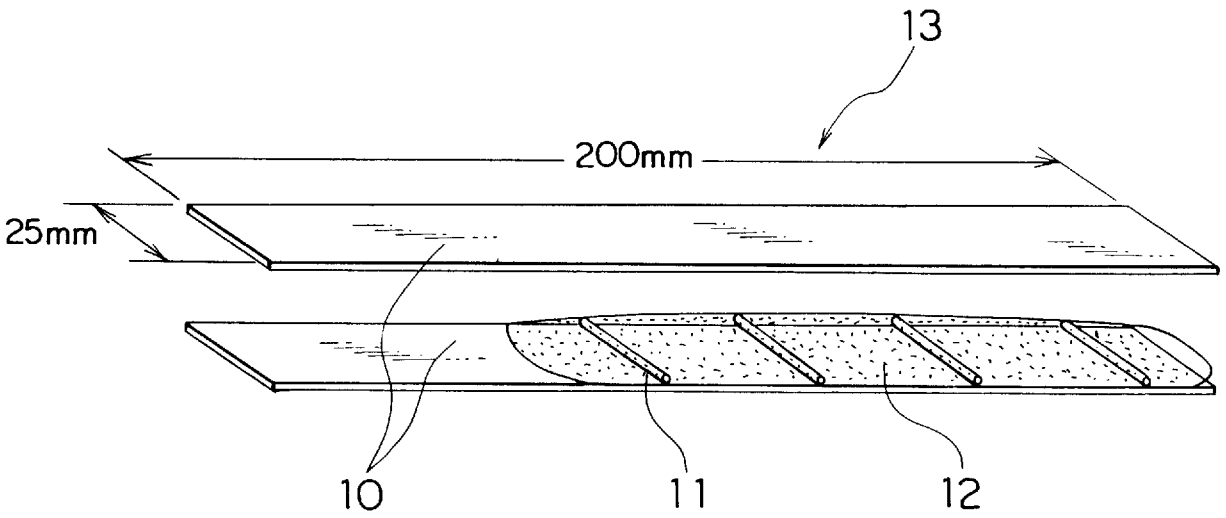
FIG. 5 is a schematic perspective view illustrating two samples to be mutually adhered through an adhesive agent for the purpose of an adhesiveness test of a zinciferous plated steel sheet.
Figure 6:
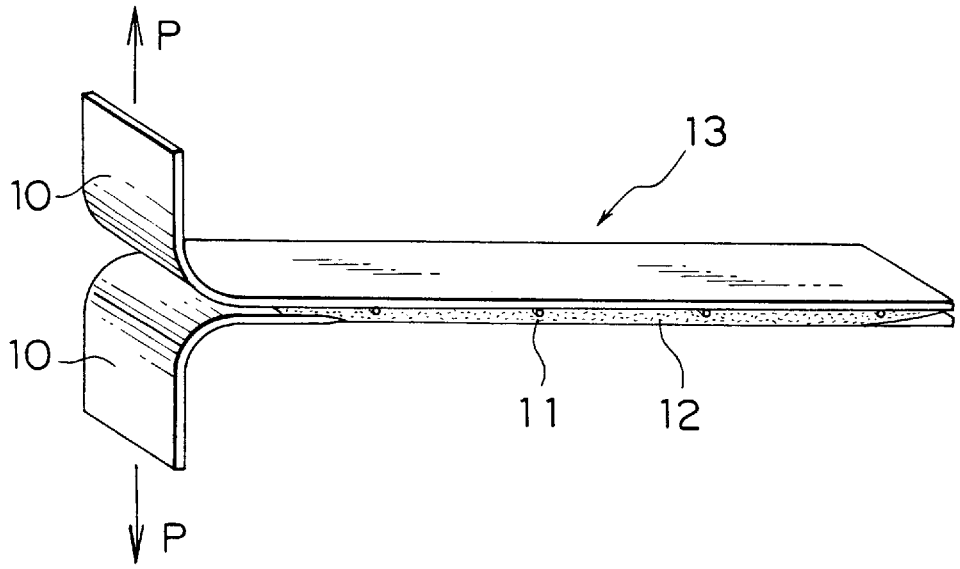
FIG. 6 is a schematic perspective view illustrating a measuring state of peeloff strength of the two samples mutually adhered through the adhesive agent, in the adhesiveness test of the zinciferous plated steel sheet.

A plurality of spacers 11 comprising round bars each having a diameter of 0.15 mm were arranged, as shown in FIG. 5, between two identical samples 10 and 10 having a width of 25 mm and a length of 200 mm at right angles to the longitudinal direction of the samples 10 at prescribed intervals, and an adhesive agent 12 was applied onto the upper surface of one of the samples 10 arranged with the spacers 11. The adhesive agent 12 had a thickness of 0.15 mm. Then, the other sample 10 was placed on the first sample 10 thus applied with the adhesive agent 12 to adhere these two samples 10 and 10, thereby preparing an assembly 13. The thus prepared assembly 13 was subjected to a baking treatment at a temperature of 150° C. for ten minutes. Ends of the two samples 10 and 10 of the thus baking-treated assembly 13 were bent in mutually opposite directions as shown in FIG. 6. Then, the ends of the samples 10 and 10 thus bent in the opposite directions were pulled in mutually opposite directions at a speed of 200 mm/minute by means of a tension tester (not shown), to measure peeloff strength upon the peeloff of the two samples 10 and 10 of the assembly 13. An average peeloff strength was determined by carrying out the same tests three times. In determining peeloff strength, an average load was determined from a load chart showing a tension load curve upon the peeloff, and peeloff strength was expressed in kgf/25 mm. In FIG. 6, the arrow P indicates the tension load. As the above-mentioned adhesive agent 12, there was used a vinyl chloride resin type adhesive agent for hemflange adhesion.

Chemical treatability test

Each sample was subjected to a chemical treatment under ordinary treatment conditions by the use of PBL3080 made by Nihon Perkerizing Co., Ltd. as a dipping-type zinc phosphating solution for under-coating of an automobile painting, to form a zinc phosphate film on the surface of each sample. Crystals of the thus formed zinc phosphate film were observed by the use of a scanning-type electron microscope. The observed states of crystals were classified into the following three stages:

○: crystals of the zinc phosphate film are dense and small;

Δ: crystals of the zinc phosphate film are somewhat coarse and large;

×: crystals of the zinc phosphate film are coarse.

The results of tests on press-formability, spot-weldability, adhesiveness and chemical treatability are shown also in Tables 1 to 3.

As is clear from Tables 1 and 2, (1) all the samples of the invention Nos. 1 to 52, in which the total quantity of the metallic elements in the Fe—Ni—O film was within a range of from 10 to 1,500 mg/m$^2$, and the oxygen content in the Fe—Ni—O film was within a range of from 0.5 to under 30 wt. %, had a small coefficient of friction, and were therefore excellent in press-formability;

(2) all the samples of the invention Nos. 1 to 46, 48, 49 and 51, in which the total quantity of the metallic elements in the Fe—Ni—O film was within a range of from 10 to 1,500 mg/m$^2$, the ratio Fe/(Fe+Ni) in the Fe—Ni—O film was within a range of from over 0 to 0.9, and the oxygen content in the Fe—Ni—O film was within a range of from 0.5 to under 30 wt. %, i.e., all the zinciferous plated steel sheets No. 2 of the present invention, had a small coefficient of friction, and a large number of continuous spot-welding runs, and were therefore excellent in press-formability and spot-weldability;

(3) all the samples of the invention Nos. 1 to 45, 47, 48 and 50 to 52, in which the total quantity of the metallic elements in the Fe—Ni—O film was within a range of from 10 to 1,500 mg/m$^2$, the ratio Fe/(Fe+Ni) in the Fe—Ni—O film was within a range of from 0.05 to under 1.0, and the oxygen content in the Fe—Ni—O film was within a range of from 0.5 to under 30 wt. %, i.e., all the zinciferous plated steel sheets No. 3 of the present invention, had a small coefficient of friction, and a high peeloff strength after adhesion, and were therefore excellent in press-formability and adhesiveness;

(4) all the samples of the invention Nos. 1 to 6 and 12 to 45, in which the total quantity of the metallic elements in the Fe—Ni—O film was within a range of from 10 to 1,500 mg/m$^2$, the ratio Fe/(Fe+Ni) in the Fe—Ni—O film was within a range of from 0.05 to 0.9, and the oxygen content in the Fe—Ni—O film was within a range of from 0.5 to 10 wt. %., i.e., all the zinciferous plated steel sheets No. 4 of the present invention, had a small coefficient of friction, a large number of continuous spot-welding runs, a high peeloff strength after adhesion, and dense and small crystals of the chemically formed film (i.e., the zinc phosphate film), and were therefore excellent in press-formability, spot-weldability, adhesiveness and chemical treatability; and (5) all the samples of the invention Nos. 12, 14, 16, 18, 25, 28, 39, 40, 43 and 45, in which the total quantity of the metallic elements in the Fe—Ni—O film was within a range of from 10 to 1,200 mg/m$^2$, the ratio Fe/(Fe +Ni) in the Fe—Ni—O film was within a range of from 0.1 to 0.3, and the oxygen content in the Fe—Ni—O film was within a range of from 0.5 to 10 wt. %, i.e., all the zinciferous plated steel sheets No. 5 of the present invention, had a small coefficient of friction, a large number of continuous spot-welding runs, a high peeloff strength after adhesion, and dense and small crystals of the chemically formed film (i.e., the zinc phosphate film), and were therefore excellent in press-formability, spot-weldability, adhesiveness and chemical treatability, and particularly, further excellent in press-formability and adhesiveness.

In contrast, as is evident from Table 3, (1) the samples for comparison Nos. 1 to 7, in which no Fe—Ni—O film was formed thereon, were poor in press-formability, spot-weldability and chemical treatability irrespective of the kind of the zinciferous plating layer, i.e., irrespective of whether the kind of the substrate sheet was GA, GI, EG, Zn—Fe, Zn—Ni, Zn—Cr or Zn—Al;

(2) the samples for comparison Nos. 8, 9, 12 and 15, in which the total quantity of the metallic elements in the Fe—Ni—O film was small outside the scope of the present invention, were inferior in press-formability, spot-weldability and chemical treatability just like the samples for comparison Nos. 1 to 7 having no Fe—Ni—O film formed thereon;

(3) the samples for comparison Nos. 10 and 13, in which the total quantity of the metallic elements in the Fe—Ni—O film was large outside the scope of the present invention, were low in chemical treatability, and (4) the samples for comparison Nos. 11 and 14, in which the total quantity of the metallic elements in the Fe—Ni—O film was within the scope of the present invention, but the oxygen content in the Fe—Ni—O film was small outside the scope of the present invention, were inferior in press-formability, spot-weldability and adhesiveness.

These results were the same irrespective of the kind of the zinciferous plating layer, i.e., irrespective of whether the kind of the substrate sheet was GA, GI, EG, Zn—Fe, Zn—Ni, Zn—Cr or Zn—Al, and irrespective of whether the forming method of the Fe—Ni—O film was the method "A", "B" or "C".

Apart from these methods "A", "B" and "C" for forming the Fe—Ni—O film, the use of the roll application method gave the same results as those presented above.

EXAMPLE 2

Samples of the invention Nos. 53 to 149 and samples for comparison Nos. 16 to 30 were prepared in the same manner as in Example 1.

For each of the above-mentioned samples of the invention and samples for comparison, the total quantity of the metallic elements in the Fe—Ni—O film, the ratio Fe/(Fe+Ni) in the Fe—Ni—O film, and the oxygen content in the Fe—Ni—O film were measured in accordance with the same methods as in Example 1.

For each of the samples of the invention Nos. 53 to 149 and the samples for comparison Nos. 16 to 30, the kind of the substrate, the forming method of the Fe—Ni—O film, the total quantity of the metallic elements in the Fe—Ni—O film, the ratio Fe/(Fe+Ni) in the Fe—Ni—O film, and the oxygen content in the Fe—Ni—O film are shown in Tables 4 to 9.

TABLE 4

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m²) | Fe / Fe + Ni | Oxygen content (wt. %) | bead "A" (μ) | bead "B" (μ) | Spot-weldability Number of continuous spot-welding runs | Adhe siveness Peeloff strength (kgf/25 mm) | Chemical treatability State of crystals of chemically formed film |
| — | 16 | GA | — | — | — | — | 0.170 | 0.250 | 3000 | 7.0 | Δ |
| — | 17 | GA | A | 5 | 0.20 | 1.0 | 0.150 | 0.200 | 3200 | 8.0 | ○ |
| — | 18 | GA | A | 8 | 0.20 | 1.0 | 0.140 | 0.160 | 3400 | 9.0 | ○ |
| 53 | — | GA | A | 10 | 0.20 | 1.0 | 0.130 | 0.155 | 5000 | 12.0 | ○ |
| 54 | — | GA | A | 30 | 0.20 | 1.0 | 0.128 | 0.154 | 5400 | 12.0 | ○ |
| 55 | — | GA | A | 50 | 0.20 | 1.0 | 0.127 | 0.151 | 5600 | 12.0 | ○ |
| 56 | — | GA | A | 100 | 0.20 | 1.0 | 0.115 | 0.150 | 6000 | 12.5 | ○ |
| 57 | — | GA | A | 200 | 0.20 | 1.0 | 0.125 | 0.148 | 6500 | 12.5 | ○ |
| 58 | — | GA | A | 300 | 0.20 | 1.0 | 0.123 | 0.149 | 7000 | 12.5 | ○ |
| 59 | — | GA | A | 400 | 0.20 | 1.0 | 0.123 | 0.148 | 7500 | 12.5 | ○ |
| 60 | — | GA | A | 500 | 0.20 | 1.0 | 0.122 | 0.148 | 7500 | 12.4 | ○ |
| 61 | — | GA | A | 600 | 0.20 | 1.0 | 0.122 | 0.146 | 8000 | 12.4 | ○ |
| 62 | — | GA | A | 800 | 0.20 | 1.0 | 0.122 | 0.145 | 8000 | 12.4 | ○ |
| 63 | — | GA | A | 1000 | 0.20 | 1.0 | 0.121 | 0.144 | 8000 | 12.2 | ○ |
| 64 | — | GA | A | 1200 | 0.20 | 1.0 | 0.121 | 0.144 | 8000 | 12.0 | ○ |
| 65 | — | GA | A | 1250 | 0.20 | 1.0 | 0.120 | 0.143 | 8500 | 11.5 | ○ |
| — | 19 | GA | A | 1600 | 0.20 | 1.0 | 0.120 | 0.144 | 9000 | 8.0 | x |

TABLE 5

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m$^2$) | Fe / Fe + Ni | Oxygen content (wt. %) | bead "A" ($\mu$) | bead "B" ($\mu$) | Spot-weldability Number of continuous spot-welding runs | Adhe siveness Peeloff strength (kgf/25 mm) | Chemical treatability State of crystals of chemically formed film |
| — | 20 | GA | A | 200 | 0.00 | 3.0 | 0.124 | 0.200 | 7000 | 8.0 | ○ |
| 66 | — | GA | A | 200 | 0.02 | 3.0 | 0.123 | 0.190 | 7000 | 9.0 | ○ |
| 67 | — | GA | A | 200 | 0.04 | 3.0 | 0.126 | 0.180 | 7000 | 11.0 | ○ |
| 68 | — | GA | A | 200 | 0.05 | 3.0 | 0.125 | 0.170 | 7000 | 12.0 | ○ |
| 69 | — | GA | A | 200 | 0.08 | 3.0 | 0.118 | 0.160 | 7000 | 12.1 | ○ |
| 70 | — | GA | A | 200 | 0.11 | 3.0 | 0.120 | 0.153 | 7000 | 12.3 | ○ |
| 71 | — | GA | A | 200 | 0.14 | 3.0 | 0.125 | 0.152 | 6500 | 12.5 | ○ |
| 72 | — | GA | A | 200 | 0.17 | 3.0 | 0.123 | 0.151 | 6500 | 12.5 | ○ |
| 73 | — | GA | A | 200 | 0.20 | 3.0 | 0.122 | 0.150 | 6500 | 12.5 | ○ |
| 74 | — | GA | A | 200 | 0.23 | 3.0 | 0.127 | 0.151 | 6500 | 12.5 | ○ |
| 75 | — | GA | A | 200 | 0.24 | 3.0 | 0.124 | 0.152 | 6500 | 12.5 | ○ |
| 76 | — | GA | A | 200 | 0.27 | 3.0 | 0.123 | 0.153 | 6500 | 12.5 | ○ |
| 77 | — | GA | A | 200 | 0.30 | 3.0 | 0.121 | 0.154 | 6500 | 12.5 | ○ |
| 78 | — | GA | A | 200 | 0.33 | 3.0 | 0.118 | 0.160 | 6000 | 12.5 | ○ |
| 79 | — | GA | A | 200 | 0.40 | 3.0 | 0.125 | 0.160 | 6000 | 12.5 | ○ |
| 80 | — | GA | A | 200 | 0.60 | 3.0 | 0.127 | 0.170 | 5500 | 12.5 | ○ |
| 81 | — | GA | A | 200 | 0.80 | 3.0 | 0.125 | 0.180 | 5500 | 12.5 | ○ |
| 82 | — | GA | A | 200 | 0.90 | 3.0 | 0.124 | 0.190 | 5000 | 12.5 | ○ |
| 83 | — | GA | A | 200 | 0.95 | 3.0 | 0.120 | 0.230 | 4000 | 12.5 | ○ |
| — | 21 | GA | A | 200 | 1.00 | 3.0 | 0.123 | 0.250 | 3000 | 12.5 | ○ |

TABLE 6

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m$^2$) | Fe / Fe + Ni | Oxygen content (wt. %) | bead "A" ($\mu$) | bead "B" ($\mu$) | Spot-weldability Number of continuous spot-welding runs | Adhe siveness Peeloff strength (kgf/25 mm) | Chemical treatability State of crystals of chemically formed film |
| — | 22 | GA | A | 200 | 0.20 | 0.0 | 0.150 | 0.200 | 7000 | 7.0 | ○ |
| — | 23 | GA | A | 200 | 0.20 | 0.2 | 0.145 | 0.170 | 7000 | 7.5 | ○ |
| — | 24 | GA | A | 200 | 0.20 | 0.4 | 0.140 | 0.160 | 7000 | 8.0 | ○ |
| 84 | — | GA | A | 200 | 0.20 | 0.5 | 0.130 | 0.155 | 6500 | 12.0 | ○ |
| 85 | — | GA | A | 200 | 0.20 | 1.5 | 0.122 | 0.150 | 6500 | 12.5 | ○ |
| 86 | — | GA | A | 200 | 0.20 | 2.0 | 0.122 | 0.148 | 6500 | 12.5 | ○ |
| 87 | — | GA | A | 200 | 0.20 | 4.0 | 0.123 | 0.148 | 6500 | 12.5 | ○ |
| 88 | — | GA | A | 200 | 0.20 | 5.0 | 0.124 | 0.147 | 6500 | 12.5 | ○ |
| 89 | — | GA | A | 200 | 0.20 | 6.0 | 0.122 | 0.146 | 6500 | 12.5 | ○ |
| 90 | — | GA | A | 200 | 0.20 | 8.0 | 0.124 | 0.148 | 6000 | 12.5 | ○ |
| 91 | — | GA | A | 200 | 0.20 | 10.0 | 0.123 | 0.148 | 6000 | 12.0 | ○ |
| 92 | — | GA | A | 200 | 0.20 | 11.0 | 0.122 | 0.150 | 5000 | 11.0 | x |
| 93 | — | GA | A | 200 | 0.20 | 22.0 | 0.122 | 0.160 | 4000 | 11.0 | x |
| 94 | — | GA | B | 30 | 0.20 | 1.0 | 0.128 | 0.154 | 5400 | 12.0 | ○ |
| 95 | — | GA | B | 200 | 0.20 | 1.0 | 0.125 | 0.150 | 6500 | 12.5 | ○ |
| 96 | — | GA | B | 1000 | 0.20 | 1.0 | 0.121 | 0.144 | 8000 | 12.2 | ○ |
| 97 | — | GA | B | 200 | 0.11 | 3.0 | 0.120 | 0.153 | 7000 | 12.3 | ○ |
| 98 | — | GA | B | 200 | 0.20 | 3.0 | 0.122 | 0.150 | 6500 | 12.5 | ○ |
| 99 | — | GA | B | 200 | 0.35 | 3.0 | 0.121 | 0.254 | 6500 | 12.5 | ○ |
| 100 | — | GA | B | 200 | 0.20 | 0.5 | 0.130 | 0.255 | 6500 | 12.0 | ○ |
| 101 | — | GA | B | 200 | 0.20 | 10.0 | 0.123 | 0.248 | 6000 | 12.0 | ○ |

TABLE 7

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m$^2$) | Fe / Fe + Ni | Oxygen content (wt. %) | bead "A" ($\mu$) | bead "B" ($\mu$) | Spot-weldability Number of continuous spot-welding runs | Adhe siveness Peeloff strength (kgf/25 mm) | Chemical treatability State of crystals of chemically formed film |
| — | 25 | GI | — | — | — | — | 0.205 | 0.300 | 800 | 3.5 | Δ |
| 102 | — | GI | A | 30 | 0.20 | 1.0 | 0.150 | 0.170 | 3500 | 12.0 | ○ |
| 103 | — | GI | A | 200 | 0.20 | 1.0 | 0.127 | 0.150 | 4000 | 12.5 | ○ |
| 104 | — | GI | A | 1000 | 0.20 | 1.0 | 0.122 | 0.142 | 5000 | 12.2 | ○ |
| 105 | — | GI | A | 200 | 0.11 | 3.0 | 0.125 | 0.153 | 4000 | 12.3 | ○ |
| 106 | — | GI | A | 200 | 0.20 | 3.0 | 0.125 | 0.150 | 4000 | 12.5 | ○ |
| 107 | — | GI | A | 200 | 0.30 | 3.0 | 0.125 | 0.154 | 4000 | 12.8 | ○ |
| 108 | — | GI | A | 200 | 0.20 | 0.5 | 0.124 | 0.155 | 4000 | 12.0 | ○ |
| 109 | — | GI | A | 200 | 0.20 | 10.0 | 0.123 | 0.186 | 4000 | 12.4 | ○ |
| — | 26 | EG | — | — | — | — | 0.223 | 0.300 | 2200 | 4.1 | Δ |
| 110 | — | EG | A | 30 | 0.20 | 1.0 | 0.150 | 0.170 | 6000 | 12.0 | ○ |
| 111 | — | EG | A | 200 | 0.20 | 1.0 | 0.125 | 0.150 | 6500 | 12.5 | ○ |
| 112 | — | EG | A | 1000 | 0.20 | 1.0 | 0.123 | 0.140 | 7000 | 12.2 | ○ |
| 113 | — | EG | A | 200 | 0.11 | 3.0 | 0.125 | 0.153 | 6500 | 12.3 | ○ |
| 114 | — | EG | A | 200 | 0.20 | 3.0 | 0.125 | 0.150 | 6500 | 12.5 | ○ |
| 115 | — | EG | A | 200 | 0.30 | 3.0 | 0.124 | 0.144 | 6500 | 12.8 | ○ |
| 116 | — | EG | A | 200 | 0.20 | 0.5 | 0.123 | 0.155 | 6500 | 12.0 | ○ |
| 117 | — | EG | A | 200 | 0.20 | 10.0 | 0.122 | 0.148 | 6000 | 12.4 | ○ |

TABLE 8

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m$^2$) | Fe / Fe + Ni | Oxygen content (wt. %) | bead "A" ($\mu$) | bead "B" ($\mu$) | Spot-weldability Number of continuous spot-welding runs | Adhe-siveness Peeloff strength (kgf/25 mm) | Chemical treatability State of crystals of chemically formed film |
| — | 27 | Zn—Fe | — | — | — | — | 0.154 | 0.175 | 3000 | 6.1 | Δ |
| 118 | — | Zn—Fe | A | 30 | 0.20 | 1.0 | 0.125 | 0.154 | 6000 | 12.0 | ○ |
| 119 | — | Zn—Fe | A | 200 | 0.20 | 1.0 | 0.125 | 0.150 | 6500 | 12.5 | ○ |
| 120 | — | Zn—Fe | A | 1000 | 0.20 | 1.0 | 0.121 | 0.140 | 7000 | 12.2 | ○ |
| 121 | — | Zn—Fe | A | 200 | 0.11 | 3.0 | 0.120 | 0.146 | 6500 | 12.3 | ○ |
| 122 | — | Zn—Fe | A | 200 | 0.20 | 3.0 | 0.122 | 0.150 | 6500 | 12.5 | ○ |
| 123 | — | Zn—Fe | A | 200 | 0.30 | 3.0 | 0.121 | 0.154 | 6500 | 12.8 | ○ |
| 124 | — | Zn—Fe | A | 200 | 0.20 | 0.5 | 0.123 | 0.155 | 6500 | 12.0 | ○ |
| 125 | — | Zn—Fe | A | 200 | 0.20 | 10.0 | 0.123 | 0.148 | 6000 | 12.4 | ○ |
| — | 28 | Zn—Ni | — | — | — | — | 0.254 | 0.175 | 6000 | 4.9 | Δ |
| 126 | — | Zn—Ni | A | 30 | 0.20 | 1.0 | 0.125 | 0.154 | 8000 | 12.0 | ○ |
| 127 | — | Zn—Ni | A | 200 | 0.20 | 1.0 | 0.124 | 0.150 | 8500 | 12.5 | ○ |
| 128 | — | Zn—Ni | A | 1000 | 0.20 | 1.0 | 0.122 | 0.140 | 10000 | 12.2 | ○ |
| 129 | — | Zn—Ni | A | 200 | 0.11 | 3.0 | 0.124 | 0.146 | 8500 | 12.3 | ○ |
| 130 | — | Zn—Ni | A | 200 | 0.20 | 3.0 | 0.124 | 0.150 | 8500 | 12.5 | ○ |
| 131 | — | Zn—Ni | A | 200 | 0.30 | 3.0 | 0.124 | 0.154 | 8500 | 12.8 | ○ |
| 132 | — | Zn—Ni | A | 200 | 0.20 | 0.5 | 0.125 | 0.155 | 8000 | 12.0 | ○ |
| 133 | — | Zn—Ni | A | 200 | 0.20 | 10.0 | 0.123 | 0.148 | 7500 | 12.4 | ○ |

TABLE 9

| | | | Fe—Ni—O film | | | | Press-formability | | | | |
|---|---|---|---|---|---|---|---|---|---|---|---|
| | | | | | | | Coefficient of friction | | | | |
| Sample of the invention No. | Sample for comparison No. | Kind of substrate sheet | Forming method | Total quantity of metallic elements (mg/m²) | Fe / Fe + Ni | Oxygen content (wt. %) | bead "A" (μ) | bead "B" (μ) | Spot-weldability Number of continuous spot-welding runs | Adhe-siveness Peeloff strength (kgf/25 mm) | Chemical treatability State of crystals of Chem-ically formed film |
| — | 29 | Zn—Cr | — | — | — | — | 0.145 | 0.170 | 3500 | 8.1 | Δ |
| 134 | — | Zn—Cr | A | 30 | 0.20 | 1.0 | 0.124 | 0.154 | 6000 | 12.0 | ○ |
| 135 | — | Zn—Cr | A | 200 | 0.20 | 1.0 | 0.122 | 0.150 | 6500 | 12.5 | ○ |
| 136 | — | Zn—Cr | A | 1000 | 0.20 | 1.0 | 0.121 | 0.144 | 7000 | 12.2 | ○ |
| 137 | — | Zn—Cr | A 200 | 0.11 | 3.0 | 0.123 | 0.153 | 6500 | 12.3 | ○ | |
| 138 | — | Zn—Cr | A | 200 | 0.20 | 3.0 | 0.124 | 0.150 | 6500 | 12.5 | ○ |
| 139 | — | Zn—Cr | A | 200 | 0.30 | 3.0 | 0.123 | 0.154 | 6500 | 12.8 | ○ |
| 140 | — | Zn—Cr | A | 200 | 0.20 | 0.5 | 0.125 | 0.155 | 6500 | 12.0 | ○ |
| 141 | — | Zn—Cr | A | 200 | 0.20 | 10.0 | 0.123 | 0.148 | 6000 | 12.4 | ○ |
| — | 30 | Zn—Al | — | — | — | — | 0.167 | 0.210 | 1000 | 1.6 | Δ |
| 142 | — | Zn—Al | A | 30 | 0.20 | 1.0 | 0.125 | 0.154 | 3500 | 12.0 | ○ |
| 143 | — | Zn—Al | A | 200 | 0.20 | 1.0 | 0.126 | 0.150 | 4000 | 12.5 | ○ |
| 144 | — | Zn—Al | A | 1000 | 0.20 | 1.0 | 0.124 | 0.144 | 5000 | 12.2 | ○ |
| 145 | — | Zn—Al | A | 200 | 0.11 | 3.0 | 0.122 | 0.153 | 4000 | 12.3 | ○ |
| 146 | — | Zn—Al | A | 200 | 0.20 | 3.0 | 0.124 | 0.150 | 4000 | 12.5 | ○ |
| 147 | — | Zn—Al | A | 200 | 0.30 | 3.0 | 0.122 | 0.154 | 4000 | 12.8 | ○ |
| 148 | — | Zn—Al | A | 200 | 0.20 | 0.5 | 0.124 | 0.155 | 4000 | 12.0 | ○ |
| 149 | — | Zn—Al | A | 200 | 0.20 | 10.0 | 0.123 | 0.148 | 4000 | 12.4 | ○ |

For each of the above-mentioned samples of the invention Nos. 53 to 149 and samples for comparison Nos. 16 to 30, tests were carried out on press-formability, spot-weldability, adhesiveness and chemical treatability, by the same methods as in Example 1. The results of tests are shown also in Tables 4 to 9.

Figure 7:
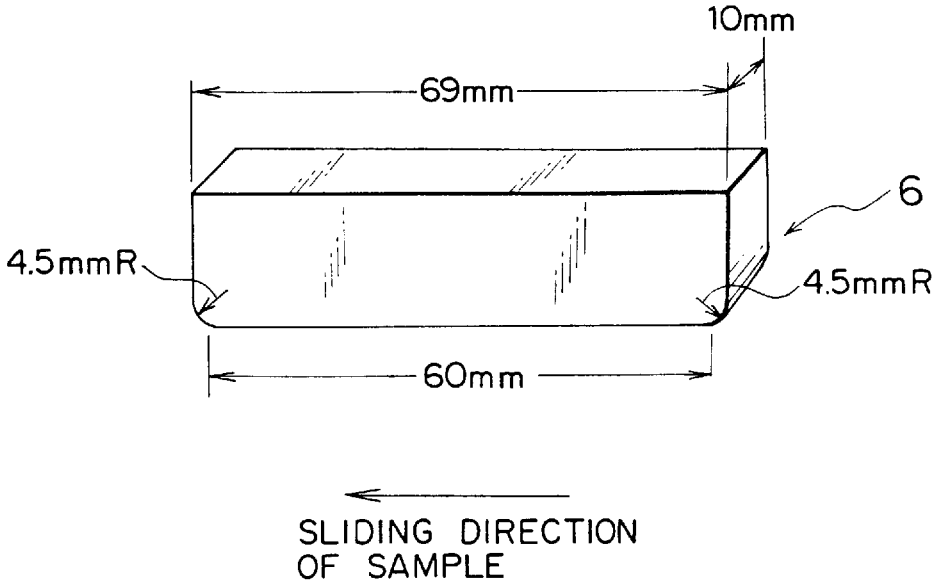
FIG. 7 is a schematic perspective view illustrating another bead of the apparatus for measuring of a coefficient of friction.

In the press-formability test, however, in addition to the use of the measuring apparatus of a coefficient of friction, which had the bead "A" as shown in FIG. 4, another measuring apparatus of a coefficient of friction, which had a bead as shown in FIG. 7 (hereinafter referred to as the bead "B") was used. While the lower end of the bead "A" had the flat face having a length of 3 mm in the sliding direction as shown in FIG. 4, the lower end of the bead "B" had a flat face having a length of 60 mm in the sliding direction as shown in FIG. 7. The press-formability test using the measuring apparatus having the bead "B" as described above was added with a view to applying severer press-forming conditions to the sample to obtain a clearer difference in the coefficient of friction between the samples.

As is clear from Tables 4 to 9, (1) all the samples of the invention Nos. 53 to 149, in which the total quantity of the metallic elements in the Fe—Ni—O film was within a range of from 10 to 1,500 mg/m², and the oxygen content in the Fe—Ni—O film was within a range of from 0.5 to under 30 wt. %, had a small coefficient of friction, and were therefore excellent in press-formability;

(2) all the samples of the invention Nos. 53 to 82 and 84 to 149, in which the total quantity of the metallic elements in the Fe—Ni—O film was within a range of from 10 to 1,500 mg/m², the ratio Fe/(Fe+Ni) in the Fe—Ni—O film was within a range of from over 0 to 0.9, and the oxygen content in the Fe—Ni—O film was within a range of from 0.5 to under 30 wt. %, i.e., all the zinciferous plated steel sheets No. 2 of the present invention, had a small coefficient of friction, and a large number of continuous spot-welding runs, and were therefore excellent in press-formability and spot-weldability;

(3) all the samples of the invention Nos. 53 to 65, 68 to 82 and 84 to 149, in which the total quantity of the metallic elements in the Fe—Ni—O film was within a range of from 10 to 1,500 mg/m², the ratio Fe/(Fe+Ni) in the Fe—Ni—O film was within a range of from 0.05 to under 1.0, and the oxygen content in the Fe—Ni—O film was within a range of from 0.5 to under 30 wt. %, i.e., all the zinciferous plated steel sheets No. 3 of the present invention, had a small coefficient of friction and a high peeloff strength after adhesion, and were therefore excellent in press-formability and adhesiveness;

(4) all the samples of the invention Nos. 53 to 65, 68 to 82, 84 to 91, and 94 to 149, in which the total quantity of the metallic elements in the Fe—Ni—O film was within a range of from 10 to 1,500 mg/m², the ratio Fe/(Fe +Ni) in the Fe—Ni—O film was within a range of from 0.05 to 0.9, and the oxygen content in the Fe—Ni—O film was within a range of from 0.5 to 10 wt. %, i.e., all the zinciferous plated steel sheets No. 4 of the present invention, had a small coefficient of friction, a large number of continuous spot-welding runs, a high peeloff strength after adhesion, and dense and small crystals of the chemically formed film (i.e., the zinc phosphate film), and were therefore excellent in press-formability, spot-weldability, adhesiveness and chemical treatability;

(5) all the samples of the invention Nos. 53 to 64, 70 to 77, 84 to 91, 94 to 98, and 100 to 149, in which the total quantity of the metallic elements in the Fe—Ni'O film was within a range of from 10 to 1,200 mg/m², the ratio Fe/(Fe+Ni) in the Fe—Ni—O film was within a range of from 0.1 to 0.3, and the oxygen content in the Fe—Ni—O film was within a range of from 0.5 to 10 wt. %, i.e., all the zinciferous plated steel sheets No. 5 of the present invention, had a small coefficient of friction, a large number of continuous spot-welding runs, a high peeloff strength after adhesion, and dense and small crystals of the chemically formed film (i.e., the zinc phosphate film), and were therefore excellent in press-formability, spot-weldability, adhesiveness and chemical treatability, and particularly, further excellent in press-formability and adhesiveness;

(6) according as the total quantity of the metallic elements in the Fe—Ni—O film increased within the scope of the present invention, press-formability and spot-weldability could further be improved (refer to the samples of the invention Nos. 53 to 65, 94 to 96, 102 to 104, 110 to 112, 118 to 120, 126 to 128, 134 to 136, and 142 to 144);

(7) by maintaining the ratio Fe/(Fe+Ni) in the Fe—Ni—O film within a range of from 0.1 to 0.3, press-formability could further be improved (refer to the column of the bead "B" of the coefficient of friction in Table 5 for the samples of the invention Nos. 70 to 77); and (8) by maintaining the ratio Fe/(Fe+Ni) in the Fe—Ni—O film within a range of from 0.1 to under 1.0, a stable and satisfactory adhesiveness was achieved among other properties (refer to the samples of the invention Nos. 70 to 83, 105 to 107, 113 to 115, 121 to 123, 129 to 131, 137 to 139 and 147 to 149).

In contrast, as is clear from Tables 4 to 9:

(1) among the samples for comparison Nos. 16 and 25 to 30, in which no Fe—Ni—O film was formed thereon, the samples for comparison Nos. 16, 27 and 30 were poor in press-formability when using the bead "A", spot-weldability and chemical treatability, the samples for comparison Nos. 25 and 26 were low in all of press-formability, spot-weldability, adhesiveness and chemical treatability, the sample for comparison No. 28, while being excellent in spot-weldability, was inferior in press-formability when using the bead "A", adhesiveness and chemical treatability, and the sample for comparison No. 29, while being excellent in press-formability and posing no particular problem in spot-weldability, was poor in adhesiveness and chemical treatability;

(2) the samples for comparison Nos. 17 and 18, in which the total quantity of the metallic elements in the Fe—Ni—O film was small outside the scope of the present invention, while posing no particular problem in press-formability and chemical treatability, were low in at least one of spot-weldability and adhesiveness;

(3) the sample for comparison No. 19, in which the total quantity of the metallic elements in the Fe—Ni—O film was large outside the scope of the present invention, while being excellent in press-formability and spot-weldability, was low in adhesiveness and chemical treatability;

(4) the sample for comparison No. 20, in which the ratio Fe/(Fe+Ni) in the Fe—Ni—O film was zero outside the scope of the present invention, while being excellent in press-formability, spot-weldability and chemical treatability, was poor in adhesiveness;

(5) the sample for comparison No. 21, in which the ratio Fe/(Fe+Ni) in the Fe—Ni—O film was 1.00 outside the scope of the present invention, while posing no particular problem in press-formability, and being excellent in adhesiveness and chemical treatability, was inferior in spot-weldability; and (6) the sample for comparison No. 22, in which the oxygen content in the Fe—Ni—O film was zero outside the scope of the present invention, and the samples for comparison Nos. 23 and 24, in which the oxygen content in the Fe—Ni—O film was small outside the scope of the present invention, while being excellent in press-formability, spot-weldability and chemical treatability, were low in adhesiveness.

EXAMPLE 3

The same seven kinds of substrate sheets as in Example 1, i.e., zinciferous plated steel sheets GA, GI, EG, Zn—Fe, Zn—Ni, Zn—Cr and Zn—Al were prepared.

Then, in accordance with any one of the following four different methods, an Fe—Ni—O film was formed on each of the both surfaces of the substrate sheet, i.e., on each of the zinciferous plating layers thereof.

(1) The substrate sheets were dipped into an aqueous solution, in which contained iron chloride ($FeCl_2$) in a prescribed quantity and nickel chloride ($NiCl_2$) in a prescribed quantity but contained no oxidizing agent, for a prescribed period of time, to form an Fe—Ni—O film on each of the zinciferous plating layers of each substrate sheet, thereby preparing zinciferous plated steel sheets within the scope of the present invention (hereinafter referred to as the "samples of the invention") and zinciferous plated steel sheets outside the scope of the present invention (hereinafter referred to as the "samples for comparison").

The contents of iron chloride and nickel chloride in the aqueous solution used for the preparation of the samples of the invention and the samples for comparison, the pH value and the temperature of the aqueous solution, the ratio of the iron content (g/l) relative to the total quantity of the iron content (g/l) and the nickel content (g/l) in the aqueous solution, and the dipping time into the aqueous solution, and the number of treatment condition comprising the combination of these conditions, are shown in Table 10.

TABLE 10

| Treatment condition No. | | Film-forming solution | | | | | |
|---|---|---|---|---|---|---|---|
| Within scope of the invention | Outside scope of the invention | $FeCl_2$ (g/l) | $NiCl_2$ (g/l) | PH value | Temp. (°C.) | Fe / Fe + Ni | Dipping time (sec.) |
| — | 1 | — | — | — | — | — | — |
| — | 2 | 0.0 | 200.0 | 2.5 | 50 | 0.000 | 10 |
| 3 | — | 0.7 | 199.3 | 2.5 | 50 | 0.0035 | 10 |
| 4 | — | 0.8 | 199.2 | 2.5 | 50 | 0.004 | 10 |
| 5 | — | 1.0 | 199.0 | 2.5 | 50 | 0.005 | 10 |
| 6 | — | 5.0 | 195.0 | 2.5 | 50 | 0.025 | 10 |

TABLE 10-continued

| Treatment condition No. | | Film-forming solution | | | | | |
|---|---|---|---|---|---|---|---|
| Within scope of the invention | Outside scope of the invention | $FeCl_2$ (g/l) | $NiCl_2$ (g/l) | PH value | Temp. (°C.) | Fe / Fe + Ni | Dipping time (sec.) |
| 7 | — | 10.0 | 190.0 | 2.5 | 50 | 0.050 | 10 |
| 8 | — | 20.0 | 180.0 | 2.5 | 50 | 0.100 | 10 |
| 9 | — | 30.0 | 170.0 | 2.5 | 50 | 0.150 | 10 |
| 10 | — | 40.0 | 160.0 | 2.5 | 50 | 0.200 | 10 |
| 11 | — | 50.0 | 150.0 | 2.5 | 50 | 0.250 | 10 |
| 12 | — | 60.0 | 140.0 | 2.5 | 50 | 0.300 | 10 |
| 13 | — | 80.0 | 120.0 | 2.5 | 50 | 0.400 | 10 |
| 14 | — | 100.0 | 100.0 | 2.5 | 50 | 0.500 | 10 |
| 15 | — | 120.0 | 80.0 | 2.5 | 50 | 0.600 | 10 |
| 16 | — | 140.0 | 60.0 | 2.5 | 50 | 0.700 | 10 |
| 17 | — | 160.0 | 40.0 | 2.5 | 50 | 0.800 | 10 |
| 18 | — | 180.0 | 20.0 | 2.5 | 50 | 0.900 | 10 |
| 19 | — | 185.0 | 15.0 | 2.5 | 50 | 0.925 | 10 |
| — | 20 | 200.0 | 0.0 | 2.5 | 50 | 1.000 | 10 |
| — | 21 | 40.0 | 160.0 | 1.5 | 50 | 0.200 | 10 |
| — | 22 | 40.0 | 160.0 | 1.9 | 50 | 0.200 | 10 |
| 23 | — | 40.0 | 160.0 | 2.0 | 50 | 0.200 | 10 |
| 24 | — | 40.0 | 160.0 | 2.25 | 50 | 0.200 | 10 |
| 25 | — | 40.0 | 160.0 | 2.75 | 50 | 0.200 | 10 |
| 26 | — | 40.0 | 160.0 | 3.0 | 50 | 0.200 | 10 |
| 27 | — | 40.0 | 160.0 | 3.25 | 50 | 0.200 | 10 |
| 28 | — | 40.0 | 160.0 | 3.5 | 50 | 0.200 | 10 |
| — | 29 | 40.0 | 160.0 | 3.5 | 50 | 0.200 | 10 |
| — | 30 | 40.0 | 160.0 | 4.0 | 50 | 0.200 | 10 |
| — | 31 | 40.0 | 160.0 | 2.5 | 10 | 0.200 | 10 |
| — | 32 | 40.0 | 160.0 | 2.5 | 19 | 0.200 | 10 |
| 33 | — | 40.0 | 160.0 | 2.5 | 20 | 0.200 | 10 |
| 34 | — | 40.0 | 160.0 | 2.5 | 30 | 0.200 | 10 |
| 35 | — | 40.0 | 160.0 | 2.5 | 40 | 0.200 | 10 |
| 36 | — | 40.0 | 160.0 | 2.5 | 60 | 0.200 | 10 |
| 37 | — | 40.0 | 160.0 | 2.5 | 70 | 0.200 | 10 |
| — | 38 | 40.0 | 160.0 | 2.5 | 71 | 0.200 | 10 |
| — | 39 | 40.0 | 160.0 | 2.5 | 80 | 0.200 | 10 |

(2) The substrate sheets were dipped into an aqueous solution, which contained iron chloride ($FeCl_2$) in a prescribed quantity, nickel chloride ($NiCl_2$) in a prescribed quantity, and an oxidizing agent in a prescribed quantity, for a prescribed period of time, to form an Fe—Ni—O film on each of the zinciferous plating layers of each substrate sheet, thereby preparing zinciferous plated steel sheets within the scope of the present invention (hereinafter referred to as the "samples of the invention").

The contents of iron chloride and nickel chloride in the aqueous solution used for the preparation of the samples of the invention, the pH value and the temperature of the aqueous solution, the ratio of the iron content (g/l) relative to the total quantity of the iron content (g/l) and the nickel content (g/l) in the aqueous solution, the dipping time, into the aqueous solution, the kind and the content of the oxidizing agent, and the number of treatment condition comprising the combination of these conditions, are shown in Table 11.

TABLE 11

| Treatment condition No. | | Film-forming solution | | | | | | Oxidizing agent | |
|---|---|---|---|---|---|---|---|---|---|
| Within scope of the invention | Outside scope of the invention | $FeCl_2$ (g/l) | $NiCl_2$ (g/l) | PH value | Temp. (°C.) | Fe / Fe + Ni | Dipping time (sec.) | Kind | Content (g/l) |
| 40 | — | 40.0 | 160.0 | 2.5 | 50 | 0.200 | 10 | $NO3^-$ | 5 |
| 41 | — | 40.0 | 160.0 | 2.5 | 50 | 0.200 | 10 | $NO2^-$ | 5 |
| 42 | — | 40.0 | 160.0 | 2.5 | 50 | 0.200 | 10 | $ClO3^-$ | 5 |
| 43 | — | 40.0 | 160.0 | 2.5 | 50 | 0.200 | 10 | $BrO3^-$ | 5 |
| 44 | — | 40.0 | 160.0 | 2.5 | 50 | 0.200 | 10 | H2O2 | 5 |
| 45 | — | 40.0 | 160.0 | 2.5 | 50 | 0.200 | 10 | KMnO4 | 5 |
| 46 | — | 40.0 | 160.0 | 2.5 | 50 | 0.200 | 10 | $ClO3^-$ & H2O2 | 10 |
| 47 | — | 40.0 | 160.0 | 2.5 | 50 | 0.200 | 10 | $BrO3^-$ & $NO2^-$ | 10 |

(3) The substrate sheets were dipped into an aqueous solution, which contained iron chloride ($FeCl_2$) in a prescribed quantity and nickel chloride ($NiCl_2$) in a prescribed quantity, but contained no oxidizing agent, for a prescribed period of time, to form an Fe—Ni—O film on each of the zinciferous plating layers of each substrate sheet. Then, each substrate sheet having the thus formed Fe—Ni—O film on each of the zinciferous plating layers thereof was heated in an oxidizing atmosphere to adjust the oxygen content in the Fe—Ni—O film, thereby preparing zinciferous plated steel sheets within the scope of the present invention (hereinafter referred to as the "samples of the invention") and zinciferous plated steel sheets outside the scope of the present invention (hereinafter referred to as the "samples for comparison").

The contents of iron chloride and nickel chloride in the aqueous solution used for the preparation of the samples of the invention and the samples for comparison, the pH value and the temperature of the aqueous solution, the ratio of the iron content (g/l) relative to the total quantity of the iron content (g/l) and the nickel content (g/l) in the aqueous solution, the dipping time into the aqueous solution, the kind of the oxidizing atmosphere, the heating temperature and the heating time, and the numbers of treatment condition comprising the combination of these conditions, are shown in Table 12.

TABLE 12

| Treatment conditions No. | | Film-forming solution | | | | | | Heating in atmosphere | | |
|---|---|---|---|---|---|---|---|---|---|---|
| Within scope of the invention | Outside scope of the invention | $FeCl_2$ (g/l) | $NiCl_2$ (g/l) | PH value | Temp. (°C.) | Fe / Fe + Ni | Dipping time (sec.) | Kind of oxidizing atmosphere | Temp. (°C.) | Time (sec.) |
| 48 | — | 40.0 | 160.0 | 2.5 | 50 | 0.200 | 10 | Open air | 40 | 20 |
| 49 | — | 40.0 | 160.0 | 2.5 | 50 | 0.200 | 10 | Open air | 50 | 20 |
| 50 | — | 40.0 | 160.0 | 2.5 | 50 | 0.200 | 10 | Open air | 80 | 10 |
| 51 | — | 40.0 | 160.0 | 2.5 | 50 | 0.200 | 10 | Open air | 150 | 10 |
| 52 | — | 40.0 | 160.0 | 2.5 | 50 | 0.200 | 10 | Open air | 300 | 10 |
| 53 | — | 40.0 | 160.0 | 2.5 | 50 | 0.200 | 10 | Open air | 450 | 5 |
| 54 | — | 40.0 | 160.0 | 2.5 | 50 | 0.200 | 10 | Open air | 600 | 5 |
| — | 55 | 40.0 | 160.0 | 2.5 | 50 | 0.200 | 10 | Open air | 650 | 5 |
| 56 | — | 40.0 | 160.0 | 2.5 | 50 | 0.200 | 10 | 50% oxygen | 80 | 5 |
| 57 | — | 40.0 | 160.0 | 2.5 | 50 | 0.200 | 10 | 50% oxygen | 150 | 5 |
| 58 | — | 40.0 | 160.0 | 2.5 | 50 | 0.200 | 10 | 100% oxygen | 80 | 5 |
| 59 | — | 40.0 | 160.0 | 2.5 | 50 | 0.200 | 10 | 100% oxygen | 150 | 5 |
| 60 | — | 40.0 | 160.0 | 2.5 | 50 | 0.200 | 10 | 50% ozone | 80 | 5 |
| 61 | — | 40.0 | 160.0 | 2.5 | 50 | 0.200 | 10 | 50% ozone | 150 | 5 |

(4) The substrate sheets were dipped into an aqueous solution, which contained iron chloride ($FeCl_2$) in a prescribed quantity and nickel chloride ($NiCl_2$) in a prescribed quantity, but contained no oxidizing agent, for a prescribed period of time, to form an Fe—Ni—O film on each of the zinciferous plating layers of each substrate sheet. Then, each substrate sheet having the thus formed Fe—Ni—O film on each of the zinciferous plating layers thereof was dipped into another aqueous solution containing an oxidizing agent for a prescribed period of time, to adjust the oxygen content in the Fe—Ni—O film, thereby preparing zinciferous plated steel sheets within the scope of the present invention (hereinafter referred to as the "samples of the invention").

The contents of iron chloride and nickel chloride in the aqueous solution used for the preparation of the samples of the invention, the pH value and the temperature of the aqueous solution, the ratio of the iron content (g/l) relative to the total quantity of the iron content (g/l) and the nickel content (g/l) in the aqueous solution (Fe/(Fe+Ni)), the dipping time in the aqueous solution not containing the oxidizing agent, the dipping time in the aqueous solution containing the oxidizing agent, the kind and the content of the oxidizing agent, and the number of treatment condition comprising the combination of these conditions, are shown in Table 13.

TABLE 13

| Treatment condition No. | | Film-forming solution | | | | | | Oxidizing agent | | |
|---|---|---|---|---|---|---|---|---|---|---|
| Within scope of the invention | Outside scope of the invention | $FeCl_2$ (g/l) | $NiCl_2$ (g/l) | PH value | Temp. (°C.) | Fe / Fe + Ni | Dipping time in solution not containing oxidizing agent (sec.) | Kind | content (g/l) | Dipping time in solution containing oxidizing agent (sec.) |
| 62 | — | 40 | 160.0 | 2.5 | 50 | 0.200 | 10 | $NO3^-$ | 5 | 10 |
| 63 | — | 40 | 160.0 | 2.5 | 50 | 0.200 | 10 | $NO2^-$ | 5 | 10 |
| 64 | — | 40 | 160.0 | 2.5 | 50 | 0.200 | 10 | $ClO3^-$ | 5 | 10 |
| 65 | — | 40 | 160.0 | 2.5 | 50 | 0.200 | 10 | $BrO3^-$ | 5 | 10 |
| 66 | — | 40 | 160.0 | 2.5 | 50 | 0.200 | 10 | H2O2 | 5 | 10 |
| 67 | — | 40 | 160.0 | 2.5 | 50 | 0.200 | 10 | KMnO4 | 5 | 10 |
| 68 | — | 40 | 160.0 | 2.5 | 50 | 0.200 | 10 | $ClO3^-$ & H2O2 | 10 | 10 |
| 69 | — | 40 | 160.0 | 2.5 | 50 | 0.200 | 10 | $BrO3^-$ & $NO2^-$ | 10 | 10 |

For each of the thus prepared samples of the invention Nos. 150 to 289 and samples for comparison Nos. 31 to 54, the total quantity of the metallic elements in the Fe—Ni—O film, the ratio Fe/(Fe+Ni) in the Fe—Ni—O film and the oxygen content in the Fe—Ni—O film were measured by the same methods as in Example 1.

For each of these samples, the number of treatment condition for forming the Fe—Ni—O film, the kind of the substrate sheet, the total quantity of the metallic elements in the Fe—Ni—O film, the ratio Fe/(Fe+Ni) in the Fe—Ni—O film, and the oxygen content in the Fe—Ni—O film are shown in Tables 14 to 21.

TABLE 14

| Sample of the invention No. | Sample for comparison No. | Treatment condition No. | Kind of substrate sheet | Fe—Ni—O film: Total quantity of metallic elements (mg/m$^2$) | Fe/(Fe + Ni) | Oxygen content (wt. %) | Press-formability Coefficient of friction ($\mu$) | Spot-weldability Continuous spot-welding runs | Adhesiveness Peeloff strength (kgf/25 mm) | Chemical treatability |
|---|---|---|---|---|---|---|---|---|---|---|
| — | 31 | 1 | GA | — | — | — | 0.160 | 3000 | 5.6 | ○ |
| — | 32 | 2 | GA | 200 | 0 | 5.0 | 0.145 | 7000 | 4.0 | ○ |
| 150 | — | 3 | GA | 200 | 0.0035 | 4.5 | 0.145 | 7000 | 7.0 | ○ |
| 151 | — | 4 | GA | 200 | 0.004 | 4.0 | 0.143 | 7000 | 10.0 | ○ |
| 152 | — | 5 | GA | 200 | 0.005 | 3.5 | 0.142 | 7000 | 10.5 | ○ |
| 153 | — | 6 | GA | 200 | 0.025 | 3.0 | 0.140 | 7000 | 11.0 | ○ |
| 154 | — | 7 | GA | 200 | 0.050 | 2.5 | 0.140 | 6750 | 11.0 | ○ |
| 155 | — | 8 | GA | 200 | 0.100 | 2.0 | 0.137 | 6750 | 12.0 | ○ |
| 156 | — | 9 | GA | 200 | 0.150 | 1.5 | 0.135 | 6750 | 13.0 | ○ |
| 157 | — | 10 | GA | 200 | 0.200 | 1.0 | 0.133 | 6500 | 13.5 | ○ |
| 158 | — | 11 | GA | 200 | 0.250 | 1.0 | 0.135 | 6500 | 13.5 | ○ |
| 159 | — | 12 | GA | 200 | 0.300 | 1.0 | 0.135 | 6500 | 13.5 | ○ |
| 160 | — | 13 | GA | 200 | 0.400 | 1.0 | 0.137 | 6000 | 13.5 | ○ |
| 161 | — | 14 | GA | 200 | 0.500 | 1.5 | 0.138 | 6000 | 13.5 | ○ |
| 162 | — | 15 | GA | 200 | 0.600 | 2.0 | 0.140 | 5500 | 13.5 | ○ |
| 163 | — | 16 | GA | 200 | 0.700 | 2.5 | 0.140 | 5250 | 13.5 | ○ |
| 164 | — | 17 | GA | 200 | 0.800 | 3.0 | 0.140 | 5000 | 13.5 | ○ |
| 165 | — | 18 | GA | 200 | 0.900 | 3.5 | 0.142 | 4500 | 13.5 | ○ |
| 166 | — | 19 | GA | 200 | 0.925 | 4.0 | 0.145 | 3500 | 13.5 | ○ |
| — | 33 | 20 | GA | 200 | 1.000 | 5.0 | 0.147 | 3000 | 13.5 | ○ |

TABLE 15

| Sample of the invention No. | Sample for comparison No. | Treatment condition No. | Kind of substrate sheet | Fe—Ni—O film: Total quantity of metallic elements (mg/m$^2$) | Fe/(Fe + Ni) | Oxygen content (wt. %) | Press-formability Coefficient of friction ($\mu$) | Spot-weldability Continuous spot-welding runs | Adhesiveness Peeloff strength (kgf/25 mm) | Chemical treatability |
|---|---|---|---|---|---|---|---|---|---|---|
| — | 34 | 21 | GA | 30 | 0.2 | 0.2 | 0.149 | 4000 | 11.0 | ○ |
| — | 35 | 22 | GA | 50 | 0.2 | 0.4 | 0.147 | 4500 | 12.0 | ○ |
| 167 | — | 23 | GA | 100 | 0.2 | 0.5 | 0.140 | 5500 | 13.5 | ○ |
| 168 | — | 24 | GA | 150 | 0.2 | 0.8 | 0.138 | 6000 | 13.5 | ○ |
| 169 | — | 25 | GA | 220 | 0.2 | 1.5 | 0.132 | 6500 | 13.5 | ○ |
| 170 | — | 26 | GA | 240 | 0.2 | 2.0 | 0.130 | 6750 | 13.0 | ○ |
| 171 | — | 27 | GA | 260 | 0.2 | 5.0 | 0.130 | 6750 | 12.5 | ○ |
| 172 | — | 28 | GA | 280 | 0.2 | 10.0 | 0.130 | 6250 | 11.5 | ○ |
| — | 36 | 29 | GA | 300 | 0.2 | 15.0 | 0.130 | 6000 | 9.0 | x |
| — | 37 | 30 | GA | 320 | 0.2 | 20.0 | 0.130 | 5000 | 8.0 | x |
| — | 38 | 31 | GA | 10 | 0.2 | 1.2 | 0.150 | 3250 | 9.0 | ○ |
| — | 39 | 32 | GA | 20 | 0.2 | 1.2 | 0.148 | 3250 | 9.5 | ○ |
| 173 | — | 33 | GA | 50 | 0.2 | 1.2 | 0.142 | 4000 | 11.5 | ○ |
| 174 | — | 34 | GA | 70 | 0.2 | 1.2 | 0.140 | 4750 | 12.0 | ○ |
| 175 | — | 35 | GA | 90 | 0.2 | 1.2 | 0.138 | 5000 | 12.5 | ○ |
| 176 | — | 36 | GA | 250 | 0.2 | 1.2 | 0.132 | 6500 | 12.5 | ○ |
| 177 | — | 37 | GA | 300 | 0.2 | 1.2 | 0.132 | 7000 | 11.5 | ○ |
| — | 40 | 38 | GA | 310 | 0.2 | 1.2 | 0.130 | 7250 | 11.0 | ○ |
| — | 41 | 39 | GA | 400 | 0.2 | 1.2 | 0.130 | 7500 | 11.0 | ○ |

TABLE 16

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| — | 42 | 1 | GI | — | — | — | 0.180 | 1000 | 2.8 | ○ |
| — | 43 | 2 | GI | 300 | 0 | 5.0 | 0.165 | 5000 | 5.8 | ○ |
| 178 | — | 4 | GI | 300 | 0.004 | 4.0 | 0.163 | 5000 | 9.3 | ○ |
| 179 | — | 8 | GI | 300 | 0.100 | 2.0 | 0.157 | 4750 | 11.8 | ○ |
| 180 | — | 10 | GI | 300 | 0.200 | 1.0 | 0.153 | 4500 | 12.3 | ○ |
| 181 | — | 12 | GI | 300 | 0.300 | 1.0 | 0.155 | 4500 | 12.3 | ○ |
| 182 | — | 15 | GI | 300 | 0.600 | 2.0 | 0.160 | 3500 | 12.3 | ○ |
| 183 | — | 18 | GI | 300 | 0.900 | 3.5 | 0.162 | 2500 | 12.3 | ○ |
| 184 | — | 19 | GI | 300 | 0.925 | 4.0 | 0.165 | 1500 | 12.3 | ○ |
| — | 44 | 1 | EG | — | — | — | 0.165 | 1500 | 2.8 | ○ |
| — | 45 | 2 | EG | 300 | 0 | 5.0 | 0.165 | 5500 | 5.8 | ○ |
| 185 | — | 4 | EG | 300 | 0.004 | 4.0 | 0.162 | 5500 | 9.3 | ○ |
| 186 | — | 8 | EG | 300 | 0.100 | 2.0 | 0.155 | 5250 | 11.8 | ○ |
| 187 | — | 10 | EG | 300 | 0.200 | 1.0 | 0.155 | 5000 | 12.3 | ○ |
| 188 | — | 12 | EG | 300 | 0.300 | 1.0 | 0.157 | 5000 | 12.3 | ○ |
| 189 | — | 15 | EG | 300 | 0.600 | 2.0 | 0.160 | 4000 | 12.3 | ○ |
| 190 | — | 18 | EG | 300 | 0.900 | 3.5 | 0.165 | 3000 | 12.3 | ○ |
| 191 | — | 19 | EG | 300 | 0.925 | 4.0 | 0.167 | 2000 | 12.3 | ○ |

TABLE 17

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| — | 46 | 1 | Zn—Fe | — | — | — | 0.155 | 4000 | 5.6 | ○ |
| — | 47 | 2 | Zn—Fe | 200 | 0 | 5.0 | 0.140 | 8000 | 4.0 | ○ |
| 192 | — | 4 | Zn—Fe | 200 | 0.004 | 4.0 | 0.138 | 8000 | 10.0 | ○ |
| 193 | — | 8 | Zn—Fe | 200 | 0.100 | 2.0 | 0.132 | 7750 | 12.0 | ○ |
| 194 | — | 10 | Zn—Fe | 200 | 0.200 | 1.0 | 0.128 | 7500 | 13.5 | ○ |
| 195 | — | 12 | Zn—Fe | 200 | 0.300 | 1.0 | 0.130 | 7500 | 13.5 | ○ |
| 196 | — | 15 | Zn—Fe | 200 | 0.600 | 2.0 | 0.135 | 6500 | 13.5 | ○ |
| 197 | — | 18 | Zn—Fe | 200 | 0.900 | 3.5 | 0.137 | 5500 | 13.5 | ○ |
| 198 | — | 19 | Zn—Fe | 200 | 0.925 | 4.0 | 0.140 | 4500 | 13.5 | ○ |
| — | 48 | 1 | Zn—Ni | — | — | — | 0.155 | 8000 | 5.6 | ○ |
| — | 49 | 2 | Zn—Ni | 200 | 0 | 5.0 | 0.140 | ≧10000 | 4.0 | ○ |
| 199 | — | 4 | Zn—Ni | 200 | 0.004 | 4.0 | 0.138 | ≧10000 | 10.0 | ○ |
| 200 | — | 8 | Zn—Ni | 200 | 0.100 | 2.0 | 0.132 | ≧10000 | 12.0 | ○ |
| 201 | — | 10 | Zn—Ni | 200 | 0.200 | 1.0 | 0.128 | ≧10000 | 13.5 | ○ |
| 202 | — | 12 | Zn—Ni | 200 | 0.300 | 1.0 | 0.130 | 9000 | 13.5 | ○ |
| 203 | — | 15 | Zn—Ni | 200 | 0.600 | 2.0 | 0.135 | 8000 | 13.5 | ○ |
| 204 | — | 18 | Zn—Ni | 200 | 0.900 | 3.5 | 0.137 | 8000 | 13.5 | ○ |
| 205 | — | 19 | Zn—Ni | 200 | 0.925 | 4.0 | 0.140 | 7000 | 13.5 | ○ |

TABLE 18

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| — | 50 | 1 | Zn—Cr | — | — | — | 0.155 | 1500 | 5.6 | ○ |
| — | 51 | 2 | Zn—Cr | 200 | 0 | 5.0 | 0.140 | 5500 | 4.0 | ○ |
| 206 | — | 4 | Zn—Cr | 200 | 0.004 | 4.0 | 0.138 | 5500 | 10.0 | ○ |
| 207 | — | 8 | Zn—Cr | 200 | 0.100 | 2.0 | 0.132 | 5250 | 12.0 | ○ |
| 208 | — | 10 | Zn—Cr | 200 | 0.200 | 1.0 | 0.128 | 5000 | 13.5 | ○ |
| 209 | — | 12 | Zn—Cr | 200 | 0.300 | 1.0 | 0.130 | 5000 | 13.5 | ○ |
| 210 | — | 15 | Zn—Cr | 200 | 0.600 | 2.0 | 0.135 | 4000 | 13.5 | ○ |
| 211 | — | 18 | Zn—Cr | 200 | 0.900 | 3.5 | 0.137 | 3000 | 13.5 | ○ |

TABLE 18-continued

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| 212 | — | 19 | Zn—Cr | 200 | 0.925 | 4.0 | 0.140 | 2000 | 13.5 | ○ |
| — | 52 | 1 | Zn—Al | — | — | — | 0.180 | 1000 | 2.8 | ○ |
| — | 53 | 2 | Zn—Al | 200 | 0 | 5.0 | 0.165 | 5000 | 5.8 | ○ |
| 213 | — | 4 | Zn—Al | 200 | 0.004 | 4.0 | 0.163 | 5000 | 9.3 | ○ |
| 214 | — | 8 | Zn—Al | 200 | 0.100 | 2.0 | 0.157 | 4750 | 11.8 | ○ |
| 215 | — | 10 | Zn—Al | 200 | 0.200 | 1.0 | 0.153 | 4500 | 12.3 | ○ |
| 216 | — | 12 | Zn—Al | 200 | 0.300 | 1.0 | 0.155 | 4500 | 12.3 | ○ |
| 217 | — | 15 | Zn—Al | 200 | 0.600 | 2.0 | 0.160 | 3500 | 12.3 | ○ |
| 218 | — | 18 | Zn—Al | 200 | 0.900 | 3.5 | 0.162 | 2500 | 12.3 | ○ |
| 219 | — | 19 | Zn—Al | 200 | 0.925 | 4.0 | 0.165 | 1500 | 12.3 | ○ |

TABLE 19

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| 220 | — | 40 | GA | 200 | 0.2 | 3.0 | 0.133 | 6500 | 13.5 | ○ |
| 221 | — | 40 | GI | 300 | 0.2 | 3.0 | 0.147 | 4500 | 12.3 | ○ |
| 222 | — | 40 | EG | 300 | 0.2 | 3.0 | 0.149 | 5000 | 12.3 | ○ |
| 223 | — | 40 | Zn—Fe | 200 | 0.2 | 3.0 | 0.122 | 7500 | 13.5 | ○ |
| 224 | — | 40 | Zn—Ni | 200 | 0.2 | 3.0 | 0.122 | ≧10000 | 13.5 | ○ |
| 225 | — | 40 | Zn—Cr | 200 | 0.2 | 3.0 | 0.122 | 5000 | 13.5 | ○ |
| 226 | — | 40 | Zn—Al | 300 | 0.2 | 3.0 | 0.147 | 4500 | 12.3 | ○ |
| 227 | — | 41 | GA | 200 | 0.2 | 3.0 | 0.133 | 6500 | 13.5 | ○ |
| 228 | — | 42 | GA | 200 | 0.2 | 3.0 | 0.132 | 6500 | 13.5 | ○ |
| 229 | — | 43 | GA | 200 | 0.2 | 3.0 | 0.134 | 6500 | 13.5 | ○ |
| 230 | — | 44 | GA | 200 | 0.2 | 3.0 | 0.133 | 6500 | 13.5 | ○ |
| 231 | — | 45 | GA | 200 | 0.2 | 3.0 | 0.133 | 6500 | 13.5 | ○ |
| 232 | — | 45 | GI | 300 | 0.2 | 3.0 | 0.147 | 4500 | 12.3 | ○ |
| 233 | — | 45 | EG | 300 | 0.2 | 3.0 | 0.149 | 5000 | 12.3 | ○ |
| 234 | — | 45 | Zn—Fe | 200 | 0.2 | 3.0 | 0.122 | 7500 | 13.5 | ○ |
| 235 | — | 45 | Zn—Ni | 200 | 0.2 | 3.0 | 0.122 | ≧10000 | 13.5 | ○ |
| 236 | — | 45 | Zn—Cr | 300 | 0.2 | 3.0 | 0.122 | 5000 | 13.5 | ○ |
| 237 | — | 45 | Zn—Al | 300 | 0.2 | 3.0 | 0.147 | 4500 | 12.3 | ○ |
| 238 | — | 46 | GA | 200 | 0.2 | 5.0 | 0.133 | 6250 | 13.0 | ○ |
| 239 | — | 47 | GA | 200 | 0.2 | 5.0 | 0.133 | 6250 | 13.0 | ○ |

TABLE 20

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| 240 | — | 48 | GA | 200 | 0.2 | 1.2 | 0.133 | 6500 | 13.5 | ○ |
| 241 | — | 49 | GA | 200 | 0.2 | 1.5 | 0.133 | 6500 | 13.5 | ○ |
| 242 | — | 50 | GA | 200 | 0.2 | 1.8 | 0.133 | 6500 | 13.5 | ○ |
| 243 | — | 51 | GA | 200 | 0.2 | 3.0 | 0.133 | 6500 | 13.5 | ○ |
| 244 | — | 51 | GI | 300 | 0.2 | 3.0 | 0.147 | 4500 | 12.3 | ○ |
| 245 | — | 51 | EG | 300 | 0.2 | 3.0 | 0.149 | 5000 | 12.3 | ○ |
| 246 | — | 51 | Zn—Fe | 200 | 0.2 | 3.0 | 0.122 | 7500 | 13.5 | ○ |
| 247 | — | 51 | Zn—Ni | 200 | 0.2 | 3.0 | 0.122 | ≧10000 | 13.5 | ○ |
| 248 | — | 51 | Zn—Cr | 200 | 0.2 | 3.0 | 0.122 | 5000 | 13.5 | ○ |
| 249 | — | 51 | Zn—Al | 300 | 0.2 | 3.0 | 0.147 | 4500 | 12.3 | ○ |
| 250 | — | 52 | GA | 200 | 0.2 | 5.0 | 0.133 | 6250 | 12.5 | ○ |
| 251 | — | 53 | GA | 200 | 0.2 | 7.0 | 0.133 | 6250 | 12.5 | ○ |
| 252 | — | 54 | GA | 200 | 0.2 | 10.0 | 0.133 | 6000 | 12.0 | ○ |
| — | 54 | 55 | GA | 200 | 0.2 | 15.0 | 0.133 | 5500 | 9.0 | x |

TABLE 20-continued

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| 253 | — | 56 | GA | 200 | 0.2 | 2.0 | 0.133 | 6500 | 13.5 | ○ |
| 254 | — | 57 | GA | 200 | 0.2 | 3.5 | 0.133 | 6500 | 13.5 | ○ |
| 255 | — | 57 | GI | 300 | 0.2 | 3.5 | 0.150 | 4500 | 12.3 | ○ |
| 256 | — | 57 | EG | 300 | 0.2 | 3.5 | 0.152 | 5000 | 12.3 | ○ |
| 257 | — | 57 | Zn—Fe | 200 | 0.2 | 3.5 | 0.125 | 7500 | 13.5 | ○ |
| 258 | — | 57 | Zn—Ni | 200 | 0.2 | 3.5 | 0.125 | ≧10000 | 13.5 | ○ |
| 259 | — | 57 | Zn—Cr | 200 | 0.2 | 3.5 | 0.125 | 5000 | 13.5 | ○ |
| 260 | — | 57 | Zn—Al | 300 | 0.2 | 3.5 | 0.150 | 4500 | 12.3 | ○ |
| 261 | — | 58 | GA | 200 | 0.2 | 4.0 | 0.133 | 6250 | 13.0 | ○ |
| 262 | — | 59 | GA | 200 | 0.2 | 7.0 | 0.132 | 6250 | 12.0 | ○ |
| 263 | — | 60 | GA | 200 | 0.2 | 5.0 | 0.131 | 6250 | 12.5 | ○ |

TABLE 21

| Sample of the invention No. | Sample for comparison No. | Treatment condition No. | Kind of substrate sheet | Fe—Ni—O film: Total quantity of metallic elements (mg/m²) | Fe/(Fe + Ni) | Oxygen content (wt. %) | Press-formability Coefficient of friction (μ) | Spot-weldability Continuous spot-welding runs | Adhesiveness Peeloff strength (kgf/25 mm) | Chemical treatability |
|---|---|---|---|---|---|---|---|---|---|---|
| 264 | — | 62 | GA | 200 | 0.2 | 3.0 | 0.133 | 6500 | 13.5 | ○ |
| 265 | — | 62 | GI | 300 | 0.2 | 3.0 | 0.150 | 4500 | 12.3 | ○ |
| 266 | — | 62 | EG | 300 | 0.2 | 3.0 | 0.152 | 5000 | 12.3 | ○ |
| 267 | — | 62 | Zn—Fe | 200 | 0.2 | 3.0 | 0.125 | 7500 | 13.5 | ○ |
| 268 | — | 62 | Zn—Ni | 200 | 0.2 | 3.0 | 0.125 | ≧10000 | 13.5 | ○ |
| 269 | — | 62 | Zn—Cr | 200 | 0.2 | 3.0 | 0.125 | 5000 | 13.5 | ○ |
| 270 | — | 62 | Zn—Al | 300 | 0.2 | 3.0 | 0.150 | 4500 | 12.3 | ○ |
| 271 | — | 63 | GA | 200 | 0.2 | 3.0 | 0.133 | 6500 | 13.5 | ○ |
| 272 | — | 64 | GA | 200 | 0.2 | 3.0 | 0.133 | 6500 | 13.5 | ○ |
| 273 | — | 65 | GA | 200 | 0.2 | 3.0 | 0.133 | 6500 | 13.5 | ○ |
| 274 | — | 66 | GA | 200 | 0.2 | 3.0 | 0.133 | 6500 | 13.5 | ○ |
| 275 | — | 66 | GI | 300 | 0.2 | 3.0 | 0.150 | 4500 | 12.3 | ○ |
| 276 | — | 66 | EG | 300 | 0.2 | 3.0 | 0.152 | 5000 | 12.3 | ○ |
| 277 | — | 66 | Zn—Fe | 200 | 0.2 | 3.0 | 0.125 | 7500 | 13.5 | ○ |
| 278 | — | 66 | Zn—Ni | 200 | 0.2 | 3.0 | 0.125 | ≧10000 | 13.5 | ○ |
| 279 | — | 66 | Zn—Cr | 200 | 0.2 | 3.0 | 0.125 | 5000 | 13.5 | ○ |
| 280 | — | 66 | Zn—Al | 300 | 0.2 | 3.0 | 0.150 | 4500 | 12.3 | ○ |
| 281 | — | 67 | GA | 200 | 0.2 | 3.0 | 0.133 | 6500 | 13.5 | ○ |
| 282 | — | 67 | GI | 300 | 0.2 | 3.0 | 0.150 | 4500 | 12.3 | ○ |
| 283 | — | 67 | EG | 300 | 0.2 | 3.0 | 0.152 | 5000 | 12.3 | ○ |
| 284 | — | 67 | Zn—Fe | 200 | 0.2 | 3.0 | 0.125 | 7500 | 13.5 | ○ |
| 285 | — | 67 | Zn—Ni | 200 | 0.2 | 3.0 | 0.125 | ≧10000 | 13.5 | ○ |
| 286 | — | 67 | Zn—Cr | 200 | 0.2 | 3.0 | 0.125 | 5000 | 13.5 | ○ |
| 287 | — | 67 | Zn—Al | 300 | 0.2 | 3.0 | 0.150 | 4500 | 12.3 | ○ |
| 288 | — | 68 | GA | 200 | 0.2 | 3.0 | 0.133 | 6500 | 13.5 | ○ |
| 289 | — | 69 | GA | 200 | 0.2 | 3.0 | 0.133 | 6500 | 13.5 | ○ |

For each of the above-mentioned samples of the invention Nos. 150 to 289 and samples for comparison Nos. 31 to 54, tests were carried out on press-formability, spot-weldability, adhesiveness and chemical treatability, by the same methods as in Example 1. However, while "NOX RUST 550HN" made by Nihon Perkerizing Co., Ltd. was used as a lubricant oil in the press-formability test in Example 1, a press cleaning oil "PRETON R352L" made by Sugimura Chemical Industrial Co., Ltd. was used as a lubricant oil in the press-formability test in Example 3. Unlike the evaluation criteria in the chemical treatability test in Example 1, the following ones were used in Example 3:

○: a zinc phosphate film is normally formed on the surface of the sample;

×: no zinc phosphate film is formed, or a zinc phosphate film is partially formed on the surface of the sample.

The results of the tests carried out on press-formability, spot-weldability, adhesiveness and chemical treatability described above are shown also in Tables 14 to 21.

As is clear from Tables 14 to 18, the samples of the invention Nos. 151 to 165, 167 to 183, 185 to 190, 192 to 197, 199 to 204, 206 to 211, and 213 to 218 were excellent in all of press-formability, spot-weldability, adhesiveness and chemical treatability. The sample of the invention No. 150, while being inferior to the above-mentioned samples of the invention 151, etc. in adhesiveness because of a relatively small ratio Fe/(Fe+Ni) in the film-forming solution, was as excellent as the above-mentioned sample of the invention No. 151, etc. in press-formability, spot-weldability and chemical treatability. The samples of the invention Nos. 166, 184, 191, 198, 212 and 219, while being inferior to the sample of the invention No. 151, etc. in spot-weldability because of a relatively large ratio Fe/(Fe+Ni) in the film-forming solution, was as excellent as the sample of the invention No. 151, etc. in press-formability, adhesiveness and chemical treatability. The sample of the invention No. 205, in which the kind of the zinciferous plating layer, i.e., the kind of the substrate sheet, was Zn—Ni, while being inferior to the samples of the invention Nos. 199 to 204 because of a relatively large ratio Fe/(Fe+Ni) in the film-forming solution, was as excellent as the samples of the invention Nos. 199 to 204 in press-formability, adhesiveness and chemical treatability.

In contrast, the samples for comparison Nos. 34 and 35 were low in the precipitation efficiency of iron and nickel because of such a small pH value of the film-forming solution as under 2.0 outside the scope of the present invention, thus resulting in a low productivity. In the samples for comparison Nos. 36 and 37, a large pH value of the film-forming solution as over 3.5 outside the scope of the present invention, caused serious oxidation of iron in the film-forming solution, resulting in occurrence of much sludge in the film-forming solution, this leading to the production of defects on the surface of the sample.

In the samples for comparison Nos. 38 and 39, productivity was low because of a low temperature of the film-forming solution as under 20° C. outside the scope of the present invention. The samples for comparison Nos. 38 and 39 were poor in spot-weldability. In the samples for comparison Nos. 40 and 41, a high temperature of the film-forming solution as over 70° C. outside the scope of the present invention resulted in a high rate of deterioration of the film-forming solution, and in addition, the production of much sludge in the film-forming solution made it difficult to continue the operation for a long time.

The samples for comparison Nos. 31, 42, 44, 46, 48, 50 and 52, in which no Fe—Ni—O film was formed thereon, were inferior in at least one of spot-weldability and adhesiveness.

The samples for comparison Nos. 32, 43, 45, 47, 49, 51 and 53, in which the ratio Fe/(Fe+Ni) in the film-forming solution was zero outside the scope of the present invention, were low at least in adhesiveness.

The sample for comparison No. 33, in which the ratio Fe/(Fe+Ni) in the film-forming solution was 1 outside the scope of the present invention, was poor in spot-weldability.

As is clear from Table 19, the samples of the invention Nos. 220 to 239 were excellent in all of press-formability, spot-weldability, adhesiveness and chemical treatability.

As is evident from Table 20, the samples of the invention Nos. 240 to 263 were excellent in all of press-formability, spot-weldability, adhesiveness and chemical treatability.

In contrast, the sample for comparison No. 54, in which the heating temperature in the oxidizing atmosphere was high as 650° C. outside the scope of the present invention, was low in chemical treatability.

As is clear from Table 21, the sample of the invention Nos. 264 to 289 were excellent in all of press-formability, spot-weldability, adhesiveness and chemical treatability.

According to the present invention, as described above in detail, since the Fe—Ni—O film formed on the zinciferous plating layer of the zinciferous plated steel sheet is harder than the zinciferous plating layer and has a higher melting point, it is possible to reduce sliding resistance between the surface of the zinciferous plated steel sheet and a die of a press during the press-forming of the zinciferous plated steel sheet, thereby facilitating the flow of the zinciferous plated steel sheet into the die of the press. In addition, since the Fe—Ni—O film contains nickel in a prescribed quantity, it is possible to ensure the formation of the nuggets which comprise a Zn—Ni alloy having a high melting point during the spot-welding, thereby inhibiting wear of the welding electrode so as to improve spot-weldability of the zinciferous plated steel sheet. Furthermore, since the Fe—Ni—O film contains iron excellent in adhesiveness in a prescribed quantity, it is possible to improve adhesiveness of the zinciferous plated steel sheet. When forming a phosphate film on the Fe—Ni—O film, moreover, since nickel and iron contained in the Fe—Ni—O film are entrapped into the phosphate crystals, it is possible to produce dense and uniform phosphate crystals having excellent adhesion, thereby enabling the formation of a phosphate film excellent in hot-water secondary adhesiveness after painting, thus providing many industrially useful effects.

What is claimed is:

1. A zinciferous plated steel sheet, which comprises:

a steel sheet, at least one zinciferous plating layer formed on at least one surface of said steel sheet, and an Fe—Ni—O film as an uppermost layer formed on said at least one zinciferous plating layer;

a total quantity of metallic elements contained in said Fe—Ni—O film being within a range of from 10 to 1,500 mg/m$^2$;

a ratio of an iron content (wt. %) relative to a total quantity of the iron content (wt. %) and a nickel content (wt. %) in said Fe—Ni—O film is within a range of from 0.0035 to under 1.0; and an oxygen content in said Fe—Ni—O film being within a range of from 0.5 to under 30 wt. %.

2. A zinciferous plated steel sheet as claimed claim 1, wherein:

the ratio of the iron content (wt. %) relative to the total quantity of the iron content (wt. %) and the nickel content (wt. %) in said Fe—Ni—O film is within a range of from 0.0035 to under 0.9.

3. A zinciferous plated steel sheet which comprises:

a steel sheet, at least one zinciferous plating layer formed on at least one surface of said steel sheet, and an Fe—Ni—O film as an uppermost layer formed on said at least one zinciferous plating layer;

a total quantity of metallic elements contained in said Fe—Ni—O film being within a range of from 10 to 1,500 mg/m$^2$;

a ratio of an iron content (wt. %) relative to a total quantity of the iron content (wt. %) and a nickel content (wt. %) in said Fe—Ni—O film is within a range of from 0.05 to under 1.0; and an oxygen content in said Fe—Ni—O film being within a range of from 0.5 to under 30 wt. %.

4. A zinciferous plated steel sheet which comprises:

a steel sheet, at least one zinciferous plating layer formed on at least one surface of said steel sheet, and an Fe—Ni—O film as an uppermost layer formed on said at least one zinciferous plating layer;

a total quantity of metallic elements contained in said Fe—Ni—O film being within a range of from 10 to 1,500 mg/m$^2$;

a ratio of an iron content (wt. %) relative to a total quantity of the iron content (wt. %) and a nickel content (wt. %) in said Fe—Ni—O film is within a range of from 0.05 to 0.9; and an oxygen content in said Fe—Ni—O film being within a range of from 0.5 to 10 wt. %.

5. A zinciferous plated steel sheet which comprises:

a steel sheet, at least one zinciferous plating layer formed on at least one surface of said steel sheet, and an Fe—Ni—O film as an uppermost layer formed on said at least one zinciferous plating layer;

a total quantity of metallic elements contained in said Fe—Ni—O film being within a range of from 10 to 1,200 $mg/m^2$;

a ratio of an iron content (wt. %) relative to a total quantity of the iron content (wt. %) and a nickel content (wt. %) in said Fe—Ni—O film is within a range of from 0.1 to 0.3; and an oxygen content in said Fe—Ni—O film being within a range of from 0.5 to under 30 wt. %.

6. A method for manufacturing a zinciferous plated steel sheet, which comprises the steps of:

subjecting a steel sheet to a zinciferous plating treatment to form at least one zinciferous plating layer on at least one surface of said steel sheet; and then, forming an Fe—Ni—O film as an uppermost layer on said at least one zinciferous plating layer by the use of an aqueous solution which contains iron chloride ($FeCl_2$) and nickel chloride ($NiCl_2$) and has a pH value within a range of from 2.25 to 3.5 and a temperature within a range of from 20° to 70° C.

7. A method for manufacturing a zinciferous plated steel sheet, which comprises the steps of:

subjecting a steel sheet to a zinciferous plating treatment to form at least one zinciferous plating layer on at least one surface of said steel sheet; and then, forming an Fe—Ni—O film as an uppermost layer on said at least one zinciferous plating layer by the use of an aqueous solution which contains an oxidizing agent, iron chloride ($FeCl_2$) and nickel chloride ($NiCl_2$) and has a pH value within a range of from 2.0 to 3.5 and a temperature within a range of from 20° to 70° C.

8. A method for manufacturing a zinciferous plated steel sheet, which comprises the steps of:

subjecting a steel sheet to a zinciferous plating treatment to form at least one zinciferous plating layer on at least one surface of said steel sheet;

then, forming an Fe—Ni—O film as an uppermost layer on said at least one zinciferous plating layer by the use of an aqueous solution which contains iron chloride ($FeCl_2$) and nickel chloride ($NiCl_2$) and has a pH value within a range of from 2.0 to 3.5 and a temperature within a range of from 20° to 70° C.; and then, said zinciferous plated steel sheet in which said Fe—Ni—O film is formed on said at least one zinciferous plating layer, being heated to a temperature within a range of from 50° to 600° C. in an oxidizing atmosphere to adjust an oxygen content in said Fe—Ni—O film.

9. A method for manufacturing a zinciferous plated steel sheet, which comprises the steps of:

subjecting a steel sheet to a zinciferous plating treatment to form at least one zinciferous plating layer on at least one surface of said steel sheet;

then, forming an Fe—Ni—O film as an uppermost layer on said at least one zinciferous plating layer by the use of an aqueous solution which does not contain an oxidizing agent, and contains iron chloride ($FeCl_2$) and nickel chloride ($NiCl_2$) and has a pH value within a range of from 2.0 to 3.5 and a temperature within a range of from 20° to 70° C; and then an oxygen content in said Fe—Ni—O film is adjusted by the use of another aqueous solution containing an oxidizing agent.

10. A method as claimed in any one of claims 6 or 7 to 9, wherein:

a ratio of the iron content (g/l) relative to the total quantity of the iron content (g/l) and the nickel content (g/l) in said aqueous solution is limited within a range of from 0.0035 to 0.9.

11. A method as claimed in any one of claims 7 to 9, wherein:

a ratio of the iron content (g/l) relative to the total quantity of the iron content (g/l) and the nickel content (g/l) in said aqueous solution is limited within a range of from 0.05 to under 1.0.

12. A method as claimed in any one of claims 7 to 9, wherein:

a ratio of the iron content (g/l) relative to the total quantity of the iron content (g/l) and the nickel content (g/l) in said aqueous solution is limited within a range of from 0.05 to 0.9.

13. A method as claimed in any one of claims 7 to 9, wherein:

a ratio of the iron content (g/l) relative to the total quantity of the iron content (g/l) and the nickel content (g/l) in said aqueous solution is limited within a range of from 0.1 to 0.3.

14. A method as claimed in claim 6, wherein:

a ratio of the iron content (g/l) relative to the total quantity of the iron content (g/l) and the nickel content (g/l) in said aqueous solution is limited within a range of from 0.05 to under 1.0.

15. A method as claimed in claim 6, wherein:

a ratio of the iron content (g/l) relative to the total quantity of the iron content (g/l) and the nickel content (g/l) in said aqueous solution is limited within a range of from 0.05 to 0.9.

16. A method as claimed in claim 6, wherein:

a ratio of the iron content (g/l) relative to the total quantity of the iron content (g/l) and the nickel content (g/l) in said aqueous solution is limited within a range of from 0.1 to 0.3.

* * * * *